US006684047B2

(12) United States Patent
Kin et al.

(10) Patent No.: US 6,684,047 B2
(45) Date of Patent: Jan. 27, 2004

(54) IMAGE FORMING APPARATUS WITH REDUCED IMAGE DEFECTS

(75) Inventors: Hidenori Kin, Nagano-ken (JP); Toru Fujita, Nagano-ken (JP); Kuniaki Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/829,012

(22) Filed: Apr. 10, 2001

(65) Prior Publication Data

US 2001/0055503 A1 Dec. 27, 2001

(30) Foreign Application Priority Data

| | | |
|---|---|---|
| Apr. 10, 2000 | (JP) | 2000-108101 |
| Apr. 10, 2000 | (JP) | 2000-108102 |
| Jul. 17, 2000 | (JP) | 2000-215258 |
| Jul. 17, 2000 | (JP) | 2000-215259 |
| Jul. 17, 2000 | (JP) | 2000-215260 |
| Mar. 2, 2001 | (JP) | 2001-057717 |
| Mar. 2, 2001 | (JP) | 2001-057718 |

(51) Int. Cl.[7] ..... G03G 15/08

(52) U.S. Cl. ..... 399/284; 399/181; 399/285; 399/289

(58) Field of Search ..... 399/274, 284, 399/285, 270, 181, 289; 347/240, 251; 358/298

(56) References Cited

U.S. PATENT DOCUMENTS

| | | | | |
|---|---|---|---|---|
| 4,286,543 A | * | 9/1981 | Ohnuma et al. | 399/274 |
| 4,755,847 A | * | 7/1988 | Matsushiro et al. | 399/284 |
| 4,777,904 A | * | 10/1988 | Gundlach et al. | 399/284 |
| 4,847,653 A | * | 7/1989 | Doi et al. | 399/284 |
| 4,866,480 A | * | 9/1989 | Hosoya et al. | 399/284 |
| 5,250,995 A | * | 10/1993 | Fare' | 399/285 |
| 5,570,166 A | * | 10/1996 | Ohzeki et al. | 399/270 |
| 5,649,197 A | * | 7/1997 | Fujita | 399/284 |
| 5,731,122 A | * | 3/1998 | Yoshida et al. | |
| 5,737,676 A | * | 4/1998 | Maeda et al. | 399/284 |
| 5,768,670 A | * | 6/1998 | Enomoto et al. | 399/284 |
| 5,870,658 A | * | 2/1999 | Goto et al. | 399/284 |
| 5,976,752 A | * | 11/1999 | Matsunaga et al. | |
| 6,134,397 A | * | 10/2000 | Shimazaki et al. | 399/285 |
| 6,163,669 A | * | 12/2000 | Aoki et al. | |
| 6,195,522 B1 | * | 2/2001 | Sato | 399/284 |
| 6,229,980 B1 | * | 5/2001 | Ogawa et al. | 399/284 |
| 6,295,437 B1 | * | 9/2001 | Hodoshima et al. | |

FOREIGN PATENT DOCUMENTS

| | | |
|---|---|---|
| JP | 9-258552 | * 10/1997 |
| JP | 9-274375 | * 10/1997 |

* cited by examiner

*Primary Examiner*—Susan S.Y. Lee
(74) *Attorney, Agent, or Firm*—Sughrue Mion, PLLC

(57) ABSTRACT

An image forming apparatus has a latent image carrier on which a latent image is formed. A developer carrier conveys a one-component non-magnetic developer and develops the latent image either in close proximity to or in contact with the latent image carrier. A voltage application unit applies an AC-superimposed bias voltage to the developer carrier. A regulating member abuts against the developer carrier to regulate the thickness of the developer layer on the developer carrier. The regulating member has a semiconductive member provided at the distal end thereof to produce an electric potential difference between the semiconductive member and the developer carrier, to which the AC-superimposed bias voltage is applied, when regulating the thickness of the developer layer on the developer carrier, thereby forming a line-shaped uneven conveying surface. Thus, the occurrence of banding and longitudinal unevenness and stripes is prevented, and fogging and scattering are also prevented. Further, the occurrence of filming is prevented, thereby allowing formation of a uniform image free from density unevenness.

35 Claims, 16 Drawing Sheets

FIG. 6

| Conditions | | Nip width | | Image quality | | | |
|---|---|---|---|---|---|---|---|
| Conveying surface | Development gap (mm) | Effective (mm) | Reciprocative (mm) | Solid uniformity | Density increase at trailing end | Half tone | Toner scattering |
| Striped | 0.1 | 4.7 | 4.2 | ◎ | ◎ | ◎ | ◎ |
| | 0.2 | 4.0 | 3.5 | ◎ | ◎ | ◎ | ◎ |
| | 0.3 | 3.4 | 2.7 | ◎ | ◎ | ◎ | ○ |
| | 0.4 | 2.7 | 1.8 | ◎ | ○ | ○ | ○ |
| | 0.5 | 2.2 | 1.0 | ◎ | ○ | ○ | ○ |
| Uniform | 0.1 | 5.7 | 3.2 | ○ | ○ | ○ | × |
| | 0.2 | 5.3 | 2.3 | ○ | ○ | ○ | × |
| | 0.3 | 5.0 | 1.2 | ○ | × | ○ | × |
| | 0.4 | 4.6 | 0.4 | × | × | × | × |
| | 0.5 | 4.3 | 0.0 | × | × | × | × |

IMAGE FORMING APPARATUS WITH REDUCED IMAGE DEFECTS

BACKGROUND OF THE INVENTION

1. Field of the Invention

The present invention relates to image forming apparatus for forming an image by developing an electrostatic latent image formed on a latent image carrier. More particularly, the present invention relates to an image forming apparatus designed to reduce the occurrence of density unevenness and stripe-shaped image defects in the formed image.

2. Discussion of Related Art

Conventionally, in the one-component non-magnetic development method, toner is supplied onto a developing roller, and the layer of toner on the developing roller is regulated with a regulating blade to a predetermined thickness to form a thin toner layer. Thereafter, a DC bias voltage or an AC bias voltage is applied to the developing roller either in or out of contact with a photosensitive member, thereby causing the toner to adhere to a latent image formed on the photosensitive member. Thus, the latent image is developed to form the desired image. In general, the developing roller in this type of image forming apparatus is driven through a gear train. Hence, the drive of the developing roller becomes unavoidably intermittent owing to the backlash in the mesh of the gears, causing feed irregularities to occur on the developing roller. Consequently, the thickness of a toner conveying surface formed on the developing roller becomes nonuniform in the circumferential direction. As a result, density unevenness (banding) occurs in the feed direction. Further, when the thickness of the toner layer on the surface of the developing roller is regulated with the regulating blade, toner is likely to clog in the nip between the developing roller and the regulating blade. For this reason, the thickness of the toner conveying surface formed on the developing roller may become uneven in the axial direction, resulting in an image containing longitudinal strip-shaped unevenness or longitudinal stripes. This causes the image quality to be degraded.

In contact development, the developing roller is brought into contact with the photosensitive member to perform development. In the contact development, toner may adhere to a non-image area, causing fogging. Further, blur may occur in a halftone image owing to disconnection, thickening or scattering of thin lines of the image. When printing is performed continuously, toner may adhere to the developing roller to give rise to a problem known as filming. This causes the toner transferability and chargeability to change, resulting in image quality degradation.

In non-magnetic color AC jumping development, an AC-superimposed bias voltage is applied to the developing roller to perform development in a state where the developing roller is out of contact with the photosensitive member. In the non-magnetic color AC jumping development, image force induced by small toner particles increases on the developing roller because of the increased charge of the small toner particles. For this reason, small toner particles cannot fly but remain in the developing device, resulting in an increase in the ratio of the amount of small toner particles remaining in the developing device to the amount of toner used for development. That is, selective consumption occurs. As a result, small toner particles are repeatedly stirred and pressed, causing filming on the developing roller and the regulating blade (i.e. the problem in terms of durability).

The magnetic brush development has the advantage that because the thickness of the toner layer can be increased, the development gap can be designed roughly. However, this development method involves the problem that it is costly because a magnet is installed on the developing sleeve, and the method cannot cope with the demand for color image formation. There are also problems inherent to this method. That is, owing to edge enhancement at the trailing end of the image, the density at the trailing end increases. Consequently, there may be undesired tailing produced by toner left uncollected by magnetic force (i.e. a phenomenon in which a trail of toner is undesirably left behind the image). With this method, the amount of toner conveyed is large, but on the other hand, charging of toner is likely to become insufficient, causing fogging.

Problems to be solved for the non-magnetic one-component development, exclusive of the magnetic brush development, include gradation degradation due to edge enhancement and an increase in density at the trailing end of the image. Regarding edge enhancement, some improvements can be made in general by reducing the development duty for adhesion of toner or applying an intermittent AC bias voltage to thereby shorten the period of time during which the toner adhesion bias voltage is applied. However, satisfactory improvements cannot be made by this method (i.e. the problem in terms of image quality, edge enhancement and fogging).

To reproduce halftone images, dithering and density pattern methods are used, and image processing using a screen structure is carried out. Various studies have been conducted and reported with regard to the relationship between the screen structure, e.g. the number of lines of the screen, and image quality, e.g. gradation reproduction and granularity. For example, it is reported in Japan Hardcopy '99 Collection of Papers, pp. 303–306, Osamu Ide, et al. "Screen Structure and Pixel Reproduction" that the relationship between the dot gain, granularity and gradation reproduction was examined by measuring the pixel reproduction accuracy in images produced by electrophotography, printing and proofing with varied screen structures and various numbers of lines. According to the report, in systems of high accuracy, the image quality has a small dependence on the screen structure, but the dependence of the image quality on the screen structure increases as the accuracy lowers. Therefore, it is important to select an optimum screen in electrophotography and so forth.

Japan Hardcopy '95 Collection of Papers, pp. 143–146, Yasuhiro Oda, et al. "New Screen Technique Designed with Importance Attached to Highlight Reproduction" reports a technique in which the screen structure is varied according to the image density to realize stable reproduction of a highlighted region in a digital xerography system in which a halftone image is constructed by a halftone screen using an image modulation method.

There is an image forming apparatus in which an image is formed by developing an electrostatic latent image formed on a latent image carrier (photosensitive member) by using a contact developing device arranged to apply an AC-superimposed bias voltage to a developer carrier (developing roller) This type of image forming apparatus involves the problem that the resulting image is unfaithful to the latent image and inferior in gradation reproduction and halftone reproduction and hence suffers from poor image quality. To form a sharp color image, it is necessary to increase the amplitude ($V_{pp}$) of the AC-superimposed bias voltage applied to the developer carrier. However, the amplitude ($V_{pp}$) of the AC-superimposed bias voltage cannot sufficiently be increased because of such restrictions as the injection of an electric charge into the latent image carrier and background fogging. Accordingly, the conventional image forming apparatus of this type is not at a practical level.

These problems may be solved effectively by a method wherein the conveying surface of the developer carrier is formed in the shape of lines. However, this method involves the problem that noise may be generated depending on the screen structure or other factors. For example, if a halftone dot screen is used in a case where a line-shaped conveying surface is formed on the developer carrier, banding (lateral unevenness) occurs unfavorably. Further, if the frequency of the screen in the feed direction synchronizes to the frequency of a line-shaped conveying surface generated by application of an AC-superimposed bias voltage, density unevenness occurs on the latent image carrier. Alternatively, the superimposition of an alternating current on the developing bias voltage applied to the developer carrier causes the latent image carrier to be vibrated, which causes the nip to be varied. If the frequency of the screen in the feed direction synchronizes to the frequency of the nip variations due to the superimposition of the alternating current, density unevenness occurs on the latent image carrier.

SUMMARY OF THE INVENTION

Accordingly, an object of the present invention is to prevent the occurrence of banding and longitudinal unevenness and stripes and prevent fogging and scattering and further prevent the occurrence of filming, thereby allowing formation of a uniform image free from density unevenness.

To attain the above-described object, the present invention provides an image forming apparatus including a latent image carrier on which a latent image is formed. A developer carrier conveys a one-component non-magnetic developer and develops the latent image either in close proximity to or in contact with the latent image carrier. A voltage application unit applies an AC-superimposed bias voltage to the developer carrier. A regulating member abuts against the developer carrier to regulate the thickness of the developer layer on the developer carrier. The regulating member has a semiconductive member provided at the distal end thereof to produce an electric potential difference between the semiconductive member and the developer carrier, to which the AC-superimposed bias voltage is applied, when regulating the thickness of the developer layer on the developer carrier.

In addition, the present invention provides an image forming apparatus including a developing unit, a latent image carrier, and a latent image forming unit. A latent image formed on the latent image carrier by the latent image forming unit is developed by the developing unit to form an image. The developing unit applies an AC-superimposed bias voltage to a developer carrier to form a thin developer layer with a line-shaped uneven conveying surface on the developer carrier with a regulating member. The latent image forming unit forms a latent image on the latent image carrier by performing image processing using a vertical parallel-line screen.

Further, the latent image forming unit forms a latent image on the latent image carrier by performing image processing using a screen structure for reproducing a halftone image. The pitch of the line-shaped uneven conveying surface is set so as not to be an integral multiple nor quotient of the dot pitch in the feed direction of the screen. The frequency of the AC-superimposed bias voltage is set so as not to be an integral multiple nor quotient of the frequency of lateral unevenness occurring in the feed direction. Thus, the relationship between the pitch of the line-shaped uneven conveying surface produced on the developer carrier by the application of the AC-superimposed bias voltage and the pitch of stripes occurring in the feed direction is set so that the pitch of the line-shaped uneven conveying surface is not an integral multiple nor quotient of the pitch of stripes.

With the above-described structure, the present invention reduces the influence of the irregularity of feeding by the driving unit and minimizes the packing of the developer in the development nip, thereby increasing the degree of freedom with which the developer is movable, and faithfully reproducing the latent image to obtain a favorable image free from noise. In addition, the present invention minimizes fogging and scattering, reduces the occurrence of clogging with aggregates of developer and eliminates longitudinal strip-shaped unevenness and longitudinal stripes. Thus, it becomes possible to attain high image quality and to increase the lifetime of the system.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIG. 6 is a diagram showing an example of comparison as to the nip width and image quality for different conveying surface configurations and different development gaps.

DESCRIPTION OF PREFERRED EMBODIMENTS

Figure 1:
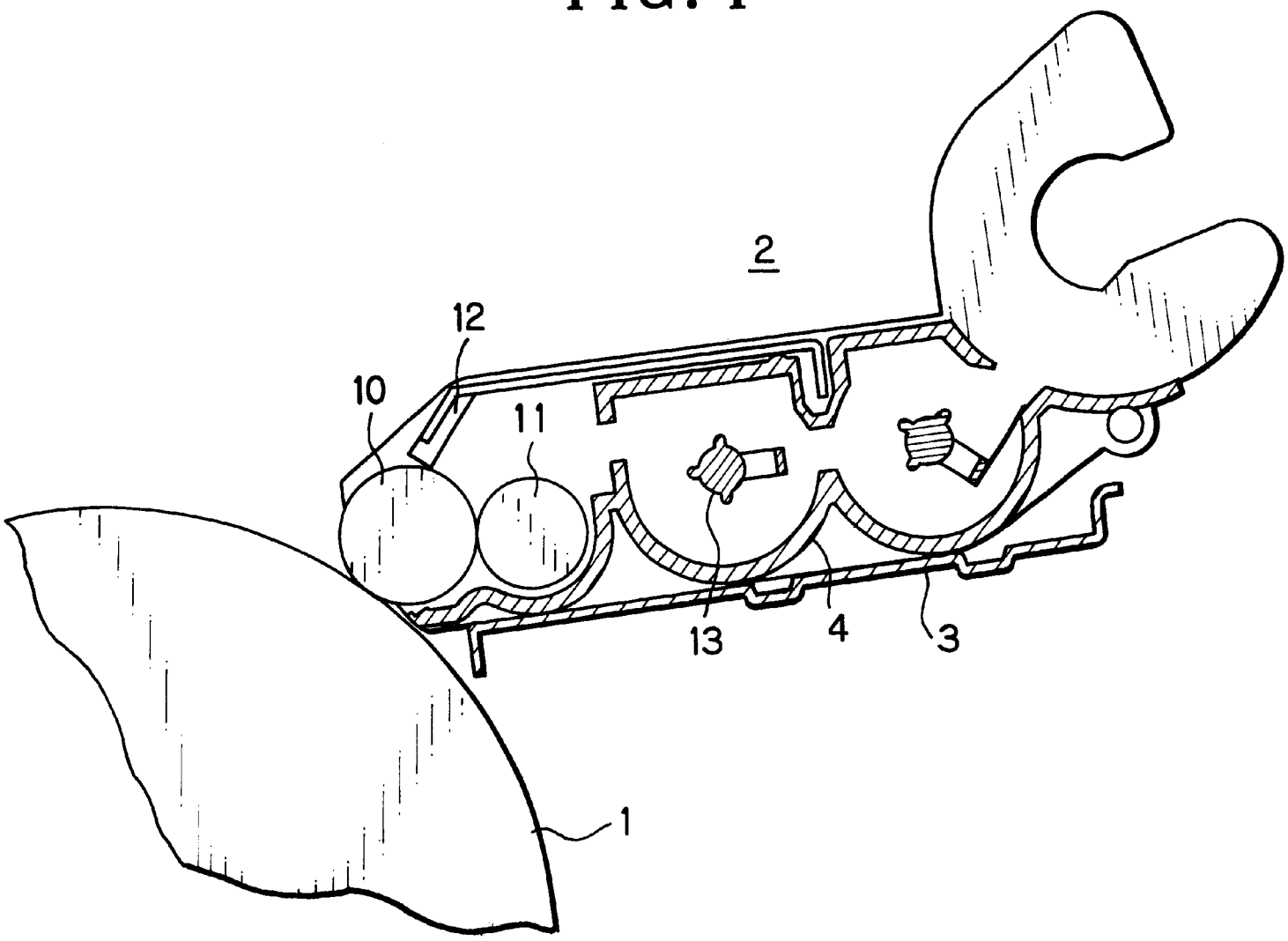
FIG. 1 is a schematic view illustrating a developing unit used in the image forming apparatus according to the present invention.

An embodiment of the present invention will be described below with reference to the accompanying drawings. FIG. 1 is a schematic view illustrating a developing unit used in the image forming apparatus according to the present invention. It should be noted that a full-color developing device has four developing units for yellow Y, magenta M, cyan C and black Bk; in FIG. 1, however, only one developing unit is shown.

In the figure, a photosensitive drum 1 serves as an electrostatic latent image carrier. The photosensitive drum 1 is an elastic roller with a photosensitive layer formed on the surface thereof. The photosensitive drum 1 is provided with a backup roller for supporting the elastic roller from the inside thereof at a position where the photosensitive drum surface contacts another member, e.g. a charging unit. A developing unit 2 is provided to face the photosensitive drum 1. The developing unit 2 has a frame 4 secured to a base 3. The frame 4 contains an agitator mechanism 13 for stirring and conveying one-component non-magnetic toner as a developer and an elastic supply roller 11 for supplying the toner conveyed from the agitator mechanism 13. The frame 4 further contains a rigid developing roller 10 serving as a developer carrier that is in resilient contact with the elastic supply roller 11 to transfer the toner supplied to the surface thereof to the elastic photosensitive member (photosensitive drum 1). Further, the frame 4 contains a regulating blade (an elastic regulating member with a rubber tip formed on the distal end of a metal member) 12 for regulating the thickness of the toner layer on the developing roller surface. It should be noted that in this embodiment the rigid developing roller 10 is a metal roller with a roughened surface, for example.

The developing roller 10 and the supply roller 11 are placed in resilient contact with each other and rotate against each other with a circumferential speed difference. In this way, the toner on the supply roller 11 is scraped onto the developing roller 10 to form a toner layer with a predetermined thickness (e.g. several hundred μm) on the developing roller surface. At this time, the toner is electrically charged to a predetermined polarity by friction between the developing roller 10 and the supply roller 11. Further, the toner is regulated to a layer thickness of the order of 10 μm with the regulating blade 12. At this time, the toner is also electrically charged to the same polarity by friction between the toner and the regulating blade 12. The developing roller 10 and the photosensitive drum 1 rotate in the forward direction while slipping owing to a circumferential speed difference. In this way, the developing roller 10 develops the electrostatic latent image on the photosensitive drum 1 in a contact or non-contact state.

Figure 2:
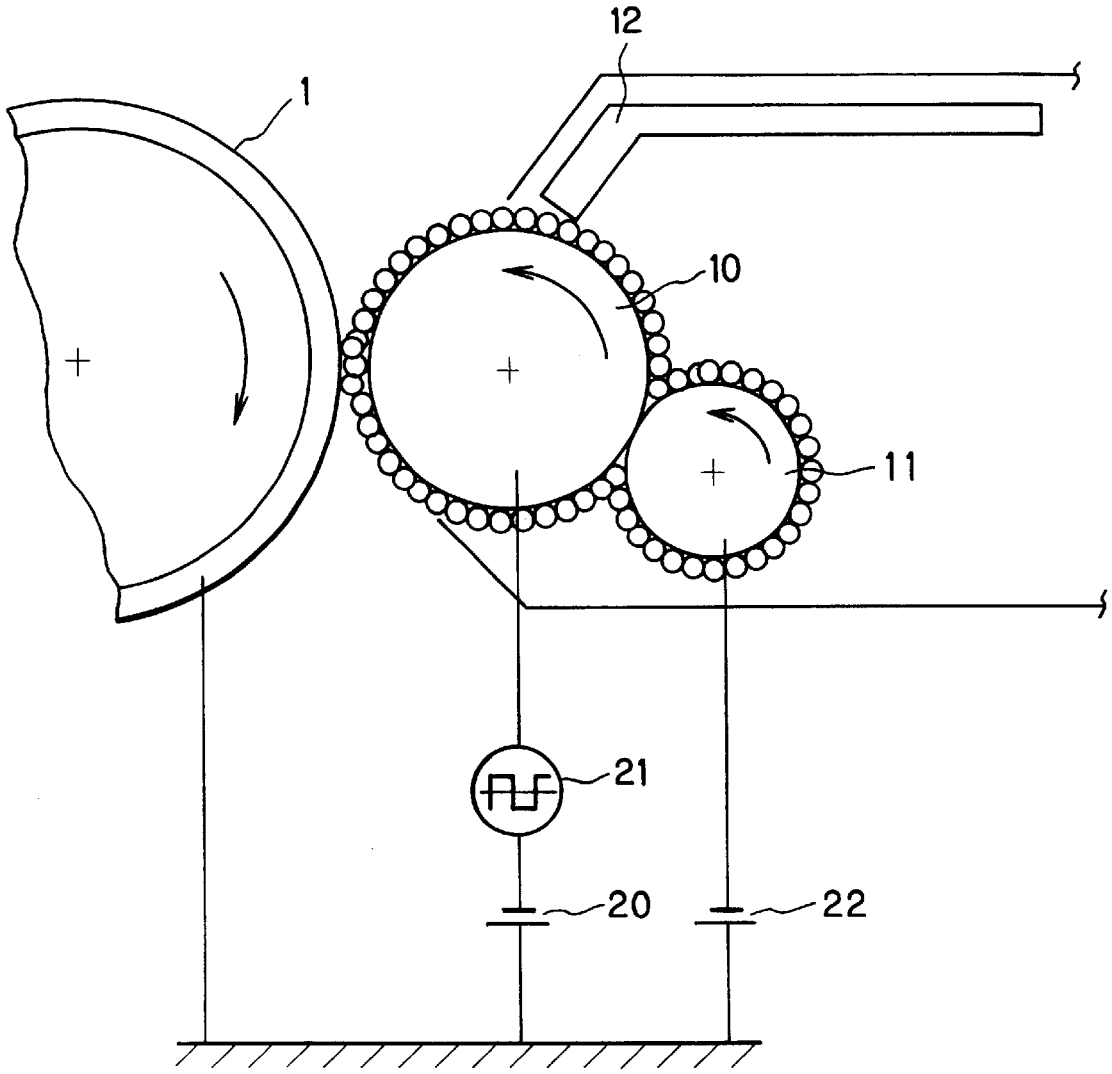
FIG. 2 is a diagram illustrating a development system according to the present invention that uses an AC-superimposed bias voltage.
Figure 3:
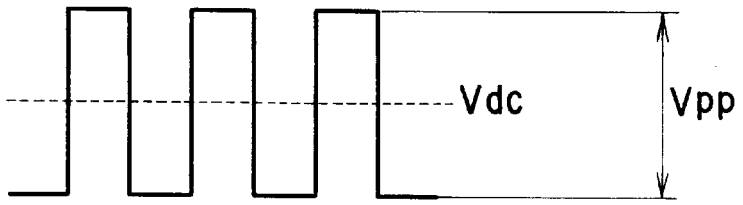
FIG. 3 is a diagram showing a rectangular AC voltage waveform.

FIG. 2 is a diagram illustrating a developing device according to the present invention that uses an AC-superimposed bias voltage. FIG. 3 is a diagram showing a rectangular AC voltage waveform. As shown in FIG. 2, an AC-superimposed bias voltage is formed by superimposing an AC voltage from an AC power source 21 on a DC voltage from a DC power source 20. The AC-superimposed bias voltage is applied to the developing roller 10 To the supply roller 11, a DC bias voltage is applied from a DC power source 22. The bias voltage applied to the supply roller 11 forms an electric field such as to supply toner to the developing roller 10. Regarding the AC-superimposed bias voltage applied to the developing roller 10, a rectangular wave is used in this embodiment, but it is also possible to use a trapezoidal wave, a triangular wave, a sine wave, etc. As shown in FIG. 3, the AC bias voltage is controlled such that the peak-to-peak voltage $V_{pp}$ is 400 V, and the frequency f is 1 kHz, for example. The frequency is set at a value larger than the frequency of vibration generated by the mesh of driving gears for the developing roller 10 (primary frequency component) and the frequency of vibration due to the addition of gear shaft decentration to the first-mentioned vibration (secondary frequency component, which is double the primary frequency component).

The DC power source 22 (constant-current voltage source) is connected to the supply roller 11 to apply a supply bias voltage thereto such that a constant current flows with respect to the developing roller 10 for each developing unit: Is =−2 μA for each of the yellow and magenta developing units; Is =−3 μA for the cyan developing unit; and Is =−5 μA for the black developing unit. The voltage is applied to each of the developing and supply rollers 10 and 11 only when the latent image on the photosensitive drum 1 is to be developed. No voltage is applied thereto on any other occasion.

Next, the operation/working-effect of the development method according to the present invention will be described. The elastic rubber provided on the distal end of the regulating blade 12 is a semiconductive rubber member having a volume resistivity of not more than $10^9$ Ωcm, preferably $10^5$ to $10^7$ Ωcm. The regulating blade 12 abuts against the metallic developing roller 10. When an AC-superimposed bias voltage is applied to the metallic developing roller 10, the developing roller 10 and the regulating blade 12 change in electric potential with a potential difference therebetween.

Regarding the potential change of the developing roller 10, let us assume the peak-to-peak voltage $V_{pp}$ is 400 V, and the potential of the developing roller 10 is changed from 0 V to −400 V, for example, as shown in FIG. 3. The mechanism by which a line-shaped uneven conveying surface is formed is as follows. An electric potential difference is produced between the regulating blade and the developing roller such that an occasion on which toner adheres to the developing roller owing to the electric potential and an occasion on which toner adheres to the regulating blade are alternately repeated, whereby a line-shaped uneven conveying surface is formed. When the regulating blade is placed at a floating potential with respect to the developing roller, the electric potential of the regulating blade rises so as to become equal to the electric potential of the developing roller with a delay corresponding to the time constant τ CR (C: the electrostatic capacity of the toner and the regulating blade rubber tip; and R: the resistance of the toner and the regulating blade rubber tip) with respect to the electric potential of the developing roller. Consequently, an electric potential difference is produced between the developing roller and the regulating blade within this period of time. In this embodiment, the regulating blade is placed at a floating potential with respect to the developing roller through the toner. However, a favorable line-shaped uneven conveying surface can also be formed when the regulating blade is placed at a constant electric potential by applying a ground potential or a DC bias voltage to the regulating blade so that an electric potential difference is produced relative to the developing roller. On the other hand, when the same AC-superimposed bias voltage is applied to both the developing roller and the regulating blade by short-circuiting them, for example, a line-shaped uneven conveying surface is not formed, but a uniform conveying surface is formed.

The line width of the line-shaped uneven conveying surface and the toner layer thickness can be controlled with the circumferential speed of the developing roller, the frequency of the AC-superimposed bias voltage, the peak-to-peak voltage, the resistance of the regulating blade rubber tip, the contact load of the regulating blade with respect to the developing roller, the width of the toner entrance opening defined when the regulating blade abuts against the developing roller, the fluidity of toner, the amount of toner charge, the surface roughness of the developing roller, the surface configuration of the developing roller, the coefficient of surface friction of the developing roller, etc.

Figure 4:
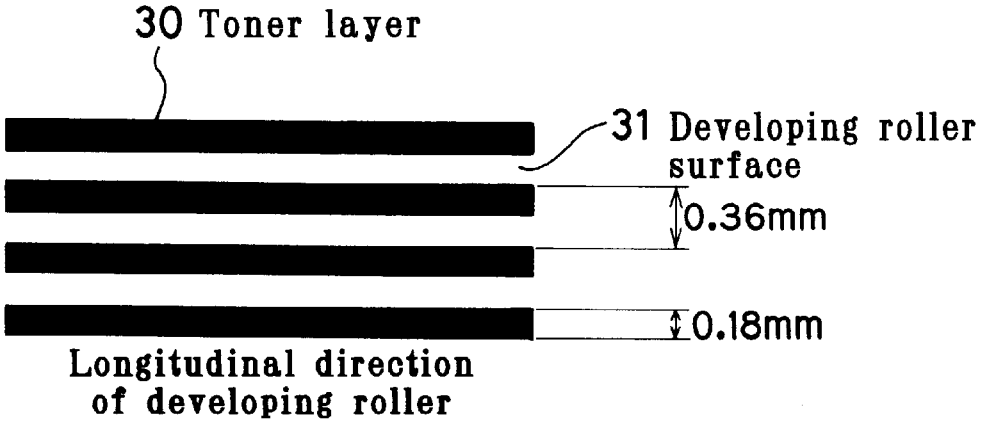
FIG. 4 is a diagram showing a line-shaped uneven conveying surface.

FIG. 4 shows a line-shaped uneven toner layer formed on the surface of the developing roller as stated above. In the figure, reference numeral 30 denotes a toner layer formed on the developing roller surface 31. The pitch and width of lines of the line-shaped uneven conveying surface depends on the frequency of the applied AC-superimposed bias voltage and the circumferential speed of the developing roller. In the image forming apparatus according to this embodiment, when the circumferential speed v of the developing roller is set at 360 mm/s and the frequency f of the AC-superimposed bias voltage is set at 1 kHz, the line-shaped uneven conveying surface has a pitch of 0.36 mm and a line width of 0.18 mm from v/f. The unevenness pattern pitch of the line-shaped uneven conveying surface can be controlled by the frequency design of the AC-superimposed bias voltage.

The line-shaped uneven conveying surface allows stabilization of the amount of toner conveyed. That is, when the pitch of the line-shaped uneven conveying surface is set smaller than the pitch of the irregularity of feeding by the developing roller driving gear, unevenness due to the intermittent feeding by the developing roller driving gear is corrected so that the amount of toner conveyed is kept constant at all times. Thus, the line-shaped uneven conveying surface allows the amount of toner conveyed to become uniform and hence makes it possible to effectively reduce the occurrence of image defects known as "banding". Regarding the AC-superimposed bias voltage, if the frequency f is set at 200 Hz or less, lateral density unevenness occurs in the image. If the frequency f is set at 5 kHz or more, the toner vibration cannot follow up and the motion of toner particles becomes close to that under application of a DC bias voltage. If the frequency f exceeds 8 kHz, the toner motion becomes the same as the motion under application of a DC bias voltage. Consequently, there is no improvement in image quality. When the quotient obtained by dividing the circumferential speed v of the developing roller by the frequency f of the AC-superimposed bias voltage is set at 0.09 mm or more by varying the conditions, favorable results are obtained. For example, when the circumferential speed v of the developing roller is 360 mm/s, favorable results are obtained by setting the frequency f of the AC-superimposed bias voltage at 4 kHz or less.

There is another cause of the occurrence of banding. That is, an undesired density difference appears in the image owing to a difference in the amount of toner used for development due to the irregularity of feeding of the developing roller at the area of contact between the photosensitive member and the developing roller. Such banding occurs when the circumferential speed varies at the time of entering the development nip even if the thickness of the conveyed toner layer is kept substantially constant. On the conveying surface when no AC bias voltage is applied to the developing roller, the toner packing ratio (the ratio of toner to space in the development nip) is as high as 80% or more, and there is almost no freedom (space) for movement of toner in the developing roller feed direction. Consequently, any difference in the amount of toner used for development at the development nip results directly in an undesired density difference in the image.

In the image forming apparatus according to the present invention, line-shaped unevenness patterns are positively formed on the conveying surface by the application of an AC-superimposed bias voltage. Therefore, the toner packing ratio is at most 50%. Moreover, because the image forming apparatus provides a high degree of freedom for movement of toner in the developing roller feed direction, toner can move freely forward and backward in the feed direction according to the developing bias voltage. As a result, toner can favorably adhere to the photosensitive member surface to reproduce the electrostatic latent image faithfully. Consequently, the occurrence of banding is eliminated. Because an elastic photosensitive member is used in this embodiment, the photosensitive member is elastically deformed at the nip. As a result, the space where toner is freely movable further increases. It is therefore possible to prevent the occurrence of banding even more effectively.

Figure 5:
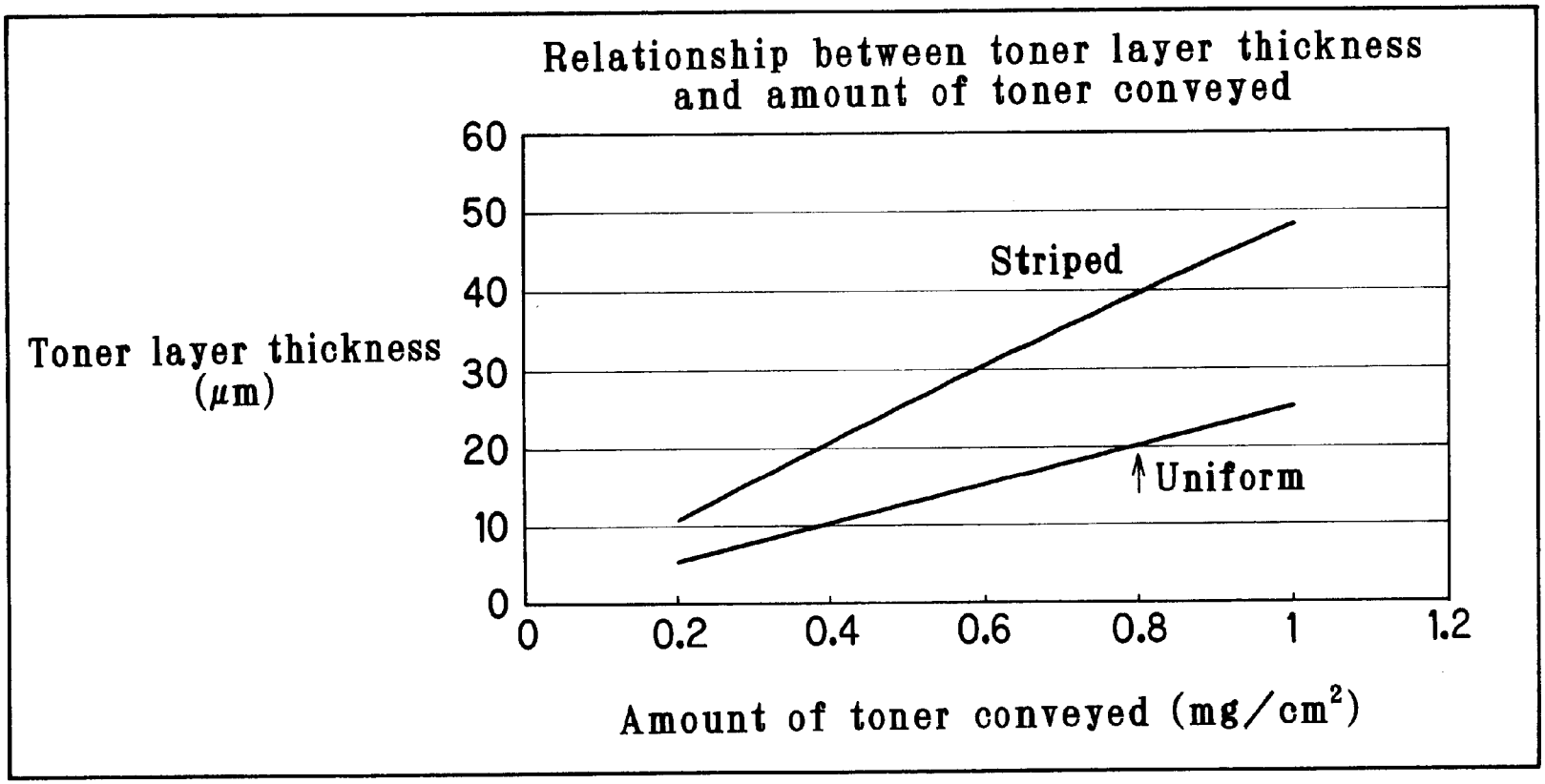
FIG. 5 is a diagram showing the relationship between the toner layer thickness and the amount of toner conveyed.

FIG. 5 is a diagram showing the relationship between the toner layer thickness and the amount of toner conveyed. The thickness of the toner layer on the developing roller was measured in a state where the developing roller was standing still by using a laser measuring device having a light-emitting unit and a light-receiving unit provided separately from each other. First, the position of the developing roller was measured in a state where no conveying surface was formed on the developing roller. Thereafter, a conveying surface was formed on the developing roller, and the position of the toner layer was measured. A difference between the measured positions was calculated to determine the thickness of the toner layer. To obtain favorable reproducibility, the toner layer thickness was measured repeatedly with an increased number of times of laser scanning, and an average value of the measured thickness values was calculated. Measurement was carried out for the developing roller when a uniform conveying surface was formed thereon and for the developing roller when a line-shaped uneven conveying surface (striped conveying surface) was formed thereon to determine the relationship between the amount of toner conveyed and the toner layer thickness. FIG. 5 shows the results of the measurement. With the line-shaped uneven conveying surface, the toner layer thickness is about double that in the case of the uniform conveying surface. Because the toner layer thickness linearly correlates with the amount of toner conveyed as shown in FIG. 5, the toner layer thickness can be varied with factors in varying the amount of toner conveyed, such as the developing roller surface roughness, the regulating load and the amount of projection of the regulating member (i.e. the length to which the distal end of a plane-contact regulating member projects from the contact position) as regulating conditions, and the fluidity of toner.

It is also possible to change the toner layer thickness by changing the condition of the line-shaped uneven conveying surface as a factor in varying the toner layer thickness other than the amount of toner conveyed. If the line-shaped uneven conveying surface is formed with enhanced contrast (i.e. toner is made to adhere properly to portions to which toner should adhere, and almost no toner is allowed to adhere to portions to which no toner should adhere), the density of toner in the portions to which toner should adhere increases even when the amount of toner conveyed is the same. Consequently, the toner layer thickness increases. An effective method of forming a line-shaped uneven conveying surface with enhanced contrast is to increase the difference in electric potential between the developing roller and the regulating blade. As the AC-superimposed bias peak-to-peak voltage $V_{pp}$ is increased, even more favorable results are obtained. As the resistance of the regulating blade is reduced, an even more favorable line-shaped uneven conveying surface can be formed. Further, the lower the frequency of the AC-superimposed bias voltage, the more the contrast of the line-shaped uneven conveying surface can be enhanced. When the frequency f is set at 2 kHz or less, the line-shaped uneven conveying surface is formed favorably, and the toner layer thickness can be increased, although this is also related to the circumferential speed of the developing roller.

Because the conveying surface is formed with line-shaped unevenness patterns, toner adhering to the non-image area is scraped off by the unevenness on the conveying surface, and thus fogging and scattering are reduced. The line-shaped uneven conveying surface is formed on the developing roller with a period of unevenness patterns corresponding to the frequency of the AC-superimposed bias voltage. When the amount of toner conveyed is the same, the thickness of toner at the projections of the line-shaped unevenness on the conveying surface is about double the toner thickness on a conventional thin-layer conveying surface. When such an uneven toner layer contacts the photosensitive member, it is easy for toner to move according to the bias electric field at the recesses of the uneven toner layer because the toner packing ratio is low at the recesses. Accordingly, toner adhering to the non-image area is readily separated toward the developing roller. Meanwhile, the projections of the uneven toner layer contact the toner adhering to the non-image area at least once. At that time, the toner adhering to the non-image area is scraped off by Van der Waals force and shifts to the developing roller. With this action, fogging and scattering can be substantially eliminated.

Furthermore, the line-shaped uneven conveying surface allows the toner layer thickness to become greater than that of a uniform conveying surface with the same amount of toner conveyed. Consequently, the void fraction increases. Therefore, the degree of freedom increases, and image force becomes less likely to act. Accordingly, even small toner particles, which have a large toner charge quantity q/m, are allowed to fly with a small electric field. In a case where the system has a development gap, flying toner particles bombard toner particles on the developing roller surface to drive them away during reciprocating motion caused by the application of the AC-superimposed bias voltage. Therefore, the toner development efficiency increases, and the development gap margin (the image stability with respect to development gap variations) increases. Further, because the area of toner covering the developing roller surface reduces to approximately half, it is possible to minimize the residual factor of small toner particles remaining on the developing roller surface and to thereby reduce the occurrence of selective development by the consumption of small toner particles. In addition, stable development characteristics can be obtained over a long period of time without the occurrence of filming. Accordingly, it is possible to increase the lifetime of the system. Moreover, because toner vibrates at the regulating area, toner particles can be electrically charged satisfactorily even when the toner layer thickness is increased. Thus, it is possible to form a large conveying surface with a stabilized toner layer thickness. In addition, fogging is unlikely to occur. Therefore, a favorable image can be obtained.

In the case of jumping development in which the developing roller is not in contact with the photosensitive member, dense and sparse toner portions are produced at the development gap according to the line-shaped uneven conveying surface, whereby line-shaped uneven "ears" are formed. Thus, during development, mechanical scraping force acts at portions where the abundance probability density of toner particles is high, and excess toner can be scraped off. Consequently, the image quality is improved. Moreover, the line-shaped uneven conveying surface allows the toner layer thickness to increase when the amount of toner conveyed is the same as that in the case of the uniform conveying surface, as shown in FIG. 5, and it becomes correspondingly easy to form ears of toner. Consequently, the distance between toner at the distal ends of the ears and the photosensitive member shortens. Therefore, the edge effect weakens favorably, and it is possible to reproduce an even more faithful image. Accordingly, it becomes possible to adopt a development mode close to the magnetic brush development, which has heretofore been unsuitable for formation of color images. Thus, it becomes possible to obtain stable development characteristics even when the development gap is roughly designed. Further, the AC-superimposed jumping development suffers from image quality degradation due to edge enhancement as a peculiar problem. However, the line-shaped uneven conveying surface allows formation of toner ears smaller than those in the magnetic brush development. Consequently, excess toner adhering to the trailing end is mechanically scraped off, thereby making it possible to reduce the increase in density at the trailing end. Moreover, because toner ears as large as those in the magnetic brush development are not formed, undesired tailing is not produced.

Figure 7:
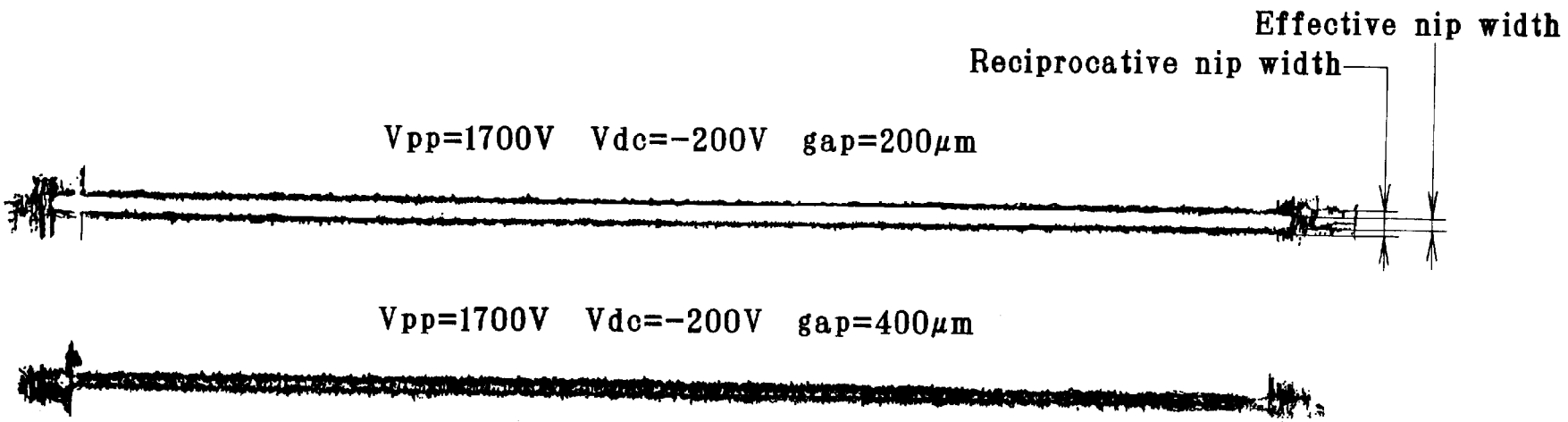
FIG. 7 is a diagram for describing a nip width measuring method.

FIG. 6 is a diagram showing an example of comparison as to the nip width and image quality for different conveying surface configurations and different development gaps. FIG. 7 is a diagram for describing a nip width measuring method. In AC jumping development wherein an AC-superimposed bias voltage is applied to the developing roller to perform development in a state where the developing roller is placed in close proximity to the photosensitive member, toner particles cannot fly when the applied electric field is lower than a predetermined level, but are restrained from leaving the developing roller. When an electric field exceeding a predetermined level is applied, the number of toner particles capable of freely reciprocating increases. Consequently, there are two regions at the development nip: a region where toner particles reciprocate between the developing roller and the photosensitive member according to the period of the alternating current; and a region outside the above region, where toner particles flying from the developing roller to the photosensitive member do not return. The width of the former region is referred to as "reciprocative nip width". The width of the latter region is referred to as "effective nip width". These nip widths were measured for different conveying surface configurations and different development gaps as shown in FIG. 6. As a result, it was possible to confirm that with the striped (line-shaped uneven) conveying surface, the toner flight can be well-controlled in comparison to the uniform conveying surface, and consequently, the probability of consumption of small toner particles increases, and development degradation can be minimized over a long period of time.

In the contact development system, it is preferable that the developing roller and the photosensitive member be placed to lightly contact each other. That is, by doing so, stress on toner is minimized, and it becomes unlikely that shaving of the photosensitive member and filming thereon will occur. If the photosensitive member is formed into a belt-like shape, the light contact between the developing roller and the photosensitive member can be achieved very effectively. The belt-shaped photosensitive member is preferably formed by using a Ni-electroformed pipe as a base material and coating the surface thereof with a photosensitive layer. With this arrangement, because the elasticity of the photosensitive member is low and deformation thereof is stable, it is possible to realize contact with a reduced load. When such a belt-shaped photosensitive member is combined with a tension roller to carry and drive it, somewhat strong tension is required in order to obviate the problem of meandering. Consequently, the pressure with which the photosensitive member contacts the developing roller increases unfavorably. A combination of a cylindrical photosensitive member with a backup roller is preferable because the drive becomes stabilized and it is possible to realize light contact between the photosensitive member and the developing roller. The load for making contact between the photosensitive member and the developing roller should be minimized; it should preferably be set at not more than 20 g/cm. It is also preferable that the ratio of the circumferential speed of the developing roller to that of the photosensitive member be not more than 2.5. With such a circumferential speed ratio, the toner packing ratio can be reduced favorably.

In the one-component non-magnetic development, it becomes possible to obtain more favorable results as the condition of development becomes closer to the contact development at a development gap of not more than 0.5 mm because of restrictions in the mechanical accuracy and the electric field with which toner particles can fly. The reciprocative nip width affects the capability of ensuring uniform density and halftone reproducibility. As the reciprocative nip width becomes wider, higher image quality can be realized. Image quality evaluation was made with regard to the capability of ensuring uniform density, the increase in density at the trailing end and halftone reproducibility to determine a preferable range of reciprocative nip widths. As a result, it was found that a reciprocative nip width of at least 0.5 mm is sufficient for practical use, and it is desirable for the reciprocative nip width to be at least 1 mm. That is, the desired image quality can be obtained with a reciprocative nip width of at least 1 mm. Regarding scattering of toner, the difference between the effective nip width and the reciprocative nip width should preferably be minimized. Favorable results are obtained when the difference is not more than 1 mm.

The effective nip width and the reciprocative nip width were measured by the following method. With the developing unit and the photosensitive member placed in contact with each other, an AC-superimposed bias voltage was applied to the developing roller, and the system was allowed to stand for 5 seconds. Thereafter, a toner image on the photosensitive member was transferred to tape. As shown in FIG. 7, the toner image transferred to the tape contains an outer portion to which a large amount of toner is attached and a central portion to which substantially no toner is attached. The largest width of the outer portion was measured as the effective nip width, and the inner portion, to which no toner was attached, was measured as the reciprocative nip width. Measurement was carried out at three points, i.e. both ends and the center, and the measured values were averaged to determine a final measured value. There were cases where the central portion had no reciprocative nip width, depending on the development gap and the AC-superimposed bias voltage conditions. In such cases, it was decided that there was no result of measurement. At the time of measurement, the developing unit and the photosensitive member were placed in a non-rotating state, and the developing roller had a line-shaped uneven conveying surface formed thereon. The surface potential of the photosensitive member was held at the exposure potential. The AC-superimposed bias voltage was applied under conditions conventionally used. In this embodiment, measurement was carried out under fixed conditions: $V_{pp}$=1700 V; $V_{dc}$=−200 V; and f=2000 Hz.

The results of measurement of the nip width for different development gaps reveal that because the line-shaped uneven conveying surface allows the toner layer thickness to increase for the same amount of toner conveyed, toner flight takes place favorably upon formation of an electric field during application of an AC-superimposed bias voltage, thus enabling favorable image quality to be obtained. Further, it is considered that the reciprocative nip width acts to improve the image quality. When the developing roller and the photosensitive member are at rest, toner particles perform reciprocating motion between them. Consequently, the number of times at which toner particles contact the electrostatic latent image on the photosensitive member increases. Therefore, latent image reproducibility is improved, and hence halftone reproducibility is improved. Moreover, because it becomes easy for toner particles to follow the electric field, the edge enhancement by the electric field at the periphery of the latent image decreases, and the increase in density at the trailing end and undesired tailing are minimized.

Thus, according to the present invention, the area of toner covering the surface of the developing roller is halved by forming a line-shaped uneven conveying surface. Consequently, it is possible to increase the toner layer thickness and to increase the void fraction by an amount corresponding to the increase in the toner layer thickness. Thus, it is possible to increase the degree of freedom of movement of toner and to make image force less liable to act. Although small toner particles have heretofore been less likely to be consumed because they have a large toner charge quantity q/m, the probability of consumption of small toner particles increases, and it is possible to minimize the residual factor of small toner particles remaining on the developing roller surface. Accordingly, it becomes possible to obtain stable development characteristics over a long period of time without the occurrence of filming or other defects. The toner layer thickness of the line-shaped uneven conveying surface can be controlled by increasing the peak-to-peak voltage $V_{pp}$ of the AC-superimposed bias voltage. Because toner vibrates at the area of contact between the developing roller and the regulating blade, toner particles can be electrically charged satisfactorily even if the toner layer thickness is increased. Moreover, it is possible to form a stable line-shaped uneven conveying surface having an increased toner layer thickness. Accordingly, fogging is unlikely to occur, and a favorable image can be obtained.

Furthermore, positively forming a line-shaped uneven conveying surface makes it possible to minimize the influence of the irregularity of feeding by the driving gear and to reduce the toner packing ratio at the development nip to thereby allow an increase in the degree of freedom of movement of toner particles. By virtue of this synergistic effect, it becomes possible to practically eliminate the occurrence of banding and hence possible to obtain a favorable image free from noise when it is formed by superimposing many colors on one another as in a color printer.

In addition, the present invention has the function of reducing clogging in the area between the regulating blade and the developing roller by the toner aggregate clashing effect. Toner in the developing device is present in the form of aggregates of certain size because the toner has been left in the developing device. Such aggregates are mechanically crushed into particles of certain size by being stirred with an agitator before being supplied to the developing roller. When entering the nip between the regulating blade and the developing roller, toner particles may be unable to pass therethrough, causing clogging. At a position clogged with toner, the amount of toner conveyed reduces, resulting in toner conveyance unevenness, e.g. longitudinal strip-shaped unevenness or a longitudinal stripe. This appears as density unevenness in the developed image. Further, toner clogging in the nip remains at that position and hence repeatedly contacts the developing roller, causing filming on the developing roller. However, in the present invention, an AC-superimposed bias voltage is applied to the developing roller to vibrate toner by electric potential variations at the first half of the nip between the regulating blade and the developing roller, thereby crushing toner aggregates. Consequently, toner enters the area between the developing roller and the regulating blade in a form close to primary particles. Accordingly, toner particles readily pass through the nip between the regulating blade and the developing roller. Alternatively, toner particles are regulated so as to flow rearward of the developing device. Therefore, clogging with toner will not occur, and a favorable image can be obtained.

The above-described actions provide advantageous effects, respectively. With the synergistic effect thereof, the developing device exhibits markedly advantageous effects when it is used as a one-component non-magnetic developing device or a developing device for a photosensitive member, and is capable of achieving an improvement in image quality and an increase in lifetime.

As has been stated above, the application of an AC-superimposed bias voltage causes the regulating blade and the developing roller to vary in electric potential with an electric potential difference therebetween. When the electric potential is high or low relative to that of toner, toner particles are allowed to pass through the nip between the regulating blade and the developing roller, whereas when the electric potential is low or high relative to that of toner, passage of toner particles is blocked, whereby a line-shaped uneven conveying surface is formed. When the regulating blade has electrical insulating properties ($10^{10}$ Ωcm or more in resistivity), the electric potential with respect to the developing roller becomes unstable by charge-up or the like, making it impossible to form a stable line-shaped uneven conveying surface. Therefore, it is not preferable to use a regulating blade having such electrical insulating properties. For this reason, it is preferable to use a regulating blade having a semiconductive rubber tip formed on the distal end of a metallic leaf spring, the semiconductive rubber tip having a volume resistivity of not more than $10^9$ Ωcm, preferably $10^5$ to $10^7$ Ωcm, and to place the regulating blade at a floating potential, a ground potential or a constant potential. By doing so, the pressure with which the regulating blade abuts against the developing roller can be kept constant, and at the same time, the nip can be increased in size. Accordingly, toner can be electrically charged satisfactorily, and an electric potential difference between the developing roller and the regulating blade can be produced with a simple arrangement. Therefore, it is possible to form a line-shaped uneven conveying surface stably and to form an image further improved in image quality.

Figure 8:
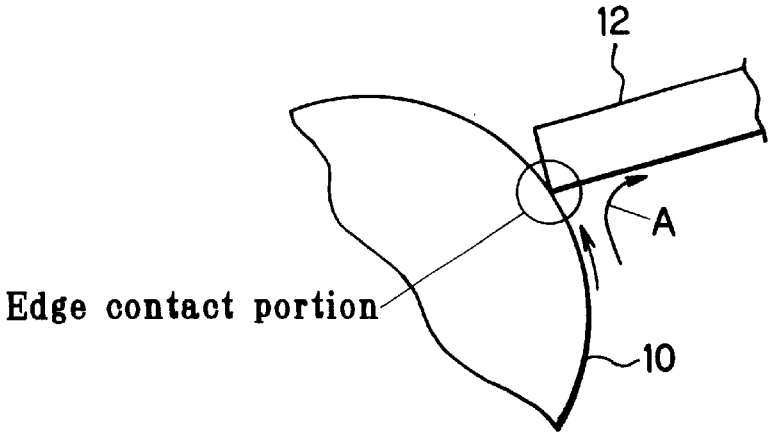
FIG. 8 is a diagram illustrating the edge contact of a regulating blade.

In addition, if the regulating blade 12 is brought into contact with the developing roller 10 at an edge of the regulating blade 12 as shown in FIG. 8, a large nip pressure can be obtained with a relatively small load. Therefore, this arrangement is favorable for formation of a uniform conveying surface. Further, toner arriving at the contact portion from the downstream side flows favorably as shown by the arrow A in the figure. Consequently, there is no toner remaining in the form of a wedge in a space with a triangular sectional configuration formed between the regulating blade and the developing roller surface as in the past. Therefore, the pressure at the wedge portion is reduced. Thus, toner clogging can be reduced.

Toner used in this embodiment is prepared by externally adding silica or a metallic oxide, e.g. titanium oxide, to a polymer toner. It is also possible to use a pulverized toner. However, a polymer toner allows the particle size distribution range to be narrowed and is uniform in shape. Therefore, favorable toner chargeability is available, and a sharp distribution can be obtained. Thus, it is possible to reduce the proportion of small toner particles with a particle size of 2 μm or less. Accordingly, favorable development characteristics can be obtained over a long period of time. Small toner particles with a particle size of 2 μm or less cause the occurrence of filming for the following reasons. First, it is difficult to make external additives adhere uniformly to matrix particles. Therefore, the exposed areas of the matrix particles are undesirably large, and the toner particles are readily adherable. Secondly, because the specific charge is large, such small toner particles are likely to be restrained on the developing roller by image force, forming a fixed layer on the developing roller. The resulting fixed layer of small toner particles is repeatedly subjected to shearing force from the regulating blade, thus causing filming to occur. Therefore, as the proportion of small toner particles decreases, the development characteristics become better.

The polymer toner in this embodiment was prepared as follows. A release agent, a coloring agent, a charge control agent, a polymerization initiator, etc. were added to a styrene polymerizable monomer and then uniformly dissolved and dispersed with an ultrasonic dispersing machine or the like to obtain a monomer system, which was then dispersed in a solvent, e.g. water, mixed with a dispersion stabilizer. The resulting dispersion was subjected to granulation under adjusted conditions concerning the stirring speed, temperature, time, etc. to form matrix particles, which were then washed and dried. Then, silica or a metallic oxide, e.g. titanium oxide, was externally added to the matrix particles by using a Henschel mixer, by way of example. The volume-average particle size D of the toner prepared in this way was 7 μm. When the particle size distribution was measured with Multisizer MS-3 (available from Coulter Electronics Co.), the number proportion of toner particles with a particle size of 3.5 μm or less was 12%. By using this toner, a developing device was prepared. Even after 10,000 sheets had been printed by using the developing device, it was possible to obtain favorable development characteristics. Further, samples with different particle size distributions were prepared by changing the polymerization conditions, and an evaluation of development characteristics was performed on the samples. Results as shown in FIG. 6 were obtained.

If the surface of the developing roller is plated, the hardness is increased. Consequently, shaving and wear of the developing roller surface are reduced, and it is possible to increase the lifetime. In addition, because the developing roller surface is smoothened by the leveling effect of plating, concentration of the electric field will not occur. Even if the peak-to-peak voltage $V_{pp}$ is increased, destruction of the latent image due to leakage to the photosensitive member will not occur. If the developing roller surface is dimpled, a uniform conveying surface can be formed. In addition, concentration of the electric field is unlikely to occur, and destruction of the latent image due to leakage to the photosensitive member is unlikely to occur. Accordingly, it is easy to control the peak-to-peak voltage $V_{pp}$, and the toner vibration effect can be readily obtained. If the developing roller surface is subjected to grinding, sphere blasting and electroless plating, a high-precision developing roller can be produced at low cost.

The average pitch of crests on the developing roller surface is measured by the method shown in JISB0601-1994 ("JIS" stands for Japanese Industrial Standards). It is preferable that the average crest pitch be smaller than the pitch (v/f) of the line-shaped uneven conveying surface. If the average crest pitch is set smaller than the pitch (v/f), the resolution at the time of forming the line-shaped uneven conveying surface increases. Accordingly, the line-shaped uneven conveying surface can be formed stably. If the developing roller is an aluminum roller, the AC bias follow-up performance is improved, and it is possible to form the line-shaped uneven conveying surface favorably. Further, a developing roller surface that satisfies the condition for the above-described average crest pitch can be readily formed by sphere blasting.

The developing roller in this embodiment is made by subjecting the surface of an aluminum shaft to nickel electroless plating after forming dimples on the surface by shot blasting. The shot blasting is carried out using spherical ceramic beads of #400 and #600 with a nozzle driven to reciprocate so that the whole area of the aluminum shaft rotated 20 rpm is subjected to shot blasting with a shot pressure of 1.5 to 2 kg/cm$^2$ and a nozzle distance of 30 cm for 30 seconds to 1 minute, thereby forming dimples on the surface of the aluminum shaft. Beads usable for the shot blasting are not necessarily limited to ceramic beads. Glass beads and iron beads, e.g. stainless steel beams, are also usable.

After the above-described shot blasting treatment, the surface roughness was measured. The surface roughness Rz was 3.5 to 7.5 $\mu$m, and Pc was 200 to 230. The average crest pitch was 0.04 to 0.05 mm. The surface of the aluminum shaft was sectioned and observed under a magnification of 500 to 1000× with an electron microscope (SEM). It was confirmed that the surface was formed with crater-like, uniform dimples.

The aluminum shaft subjected to the above-described shot blasting was then subjected to nickel electroless plating to form a nickel plating layer, thereby completing a developing roller. More specifically, plating was carried out so that a plating layer thickness of 3 to 5 $\mu$m would be obtained. After washing, degreasing and pretreatment, nickel electroless plating was performed. Thereafter, the plated aluminum shaft was washed and dried to produce a developing roller. The surface roughness of the developing roller after the plating process was measured. The surface roughness Rz was 7 $\mu$m, and Pc was 220. The surface of the developing roller was observed under a magnification of 500 to 000× with an electron microscope. It was confirmed that the nickel plating layer was formed, exactly following the underlying shot-blasted surface, and the dimple configuration observed after the shot blasting treatment was left with excellent reproducibility.

The regulating blade is a rigid metal plate with a rubber tip provided at the distal end thereof. As the rigid metal plate, a stainless steel plate with a thickness of 1.5 mm is used, and urethane rubber is used as the rubber tip. In general, urethane rubber has a low resistance value and hence can provide a certain degree of electrical conductivity without the need to add an electrically-conductive material thereto. In this embodiment, however, carbon black is dispersed in the urethane rubber material to obtain an electrical conductivity of $10^5$ Ωcm as expressed by volume resistivity. When the volume resistivity of urethane rubber is high, the electric potential with respect to the developing roller may become unstable owing to charge-up or the like. In such a case, the conveying surface of the developing roller fails to become a line-shaped uneven conveying surface. Alternatively, the lines of the line-shaped uneven conveying surface become extremely low in contrast. The volume resistivity of the urethane rubber was varied to evaluate the quality of the line-shaped uneven conveying surface formed. As a result, it was found that an ideal line-shaped uneven conveying surface can be formed when the volume resistivity of the urethane rubber is not more than $10^9$ Ωcm. In addition, when urethane rubber is used as a blade, the wear thereof is favorably small, and a desired nip can be formed stably. Therefore, it is easy to form a line-shaped uneven conveying surface. It is preferable that the rubber hardness Hs of urethane rubber be 55 to 80 degrees according to JIS A. If the rubber hardness is excessively high, the rubber elasticity becomes unable to function as desired. As a result, it becomes impossible for the blade to follow the developing roller satisfactorily. Hence, it becomes difficult to form a line-shaped uneven conveying surface on the developing roller. When the rubber hardness is excessively low, rubber vibrates undesirably when contacting the developing roller. The vibration of the rubber disturbs the line-shaped uneven conveying surface, which should be formed in correspondence to the frequency of the AC-superimposed bias voltage.

In the image forming apparatus according to this embodiment, a urethane rubber material with a rubber hardness of 70 degrees is used. Such a urethane rubber material is provided on the distal end of a rigid metal plate by injection molding process. After the injection molding process, a portion of the rubber that is to contact the developing roller is ground to a shape with a predetermined radius. A step portion is formed on the regulating blade during the inspection process. A step portion with a desired size is produced at a desired position by appropriately selecting the configuration of the grinding wheel and the volume of material removed. It is also possible to form a step portion with a desired size at a desired position by employing a mold used in the injection molding process. The regulating blade in this embodiment is formed with a step portion of 0.1 mm in size at a position 1.5 mm away from the contact position. The regulating blade surface roughness is produced by changing the roughness of the grinding wheel used in the grinding process. The surface roughness Ra at the upstream side is 0.3 $\mu$m. The surface roughness Ra at the downstream side is 0.08 $\mu$m. The regulating blade produced in this way is brought into contact with the developing roller at an edge thereof. The regulating blade is provided with a positioning slot so that the edge contact is kept at a fixed angle and parallel to the developing roller with a positioning pin. The edge contact enables a thin toner layer to be formed with a reduced contact load and allows a reduction in the area of a wedge-shaped portion (i.e. a triangular portion between the regulating blade and the developing roller) where toner enters. Consequently, toner clogging becomes unlikely to occur, and it is possible to form a line-shaped uneven conveying surface uniform in the longitudinal direction of the developing roller.

Figure 9:
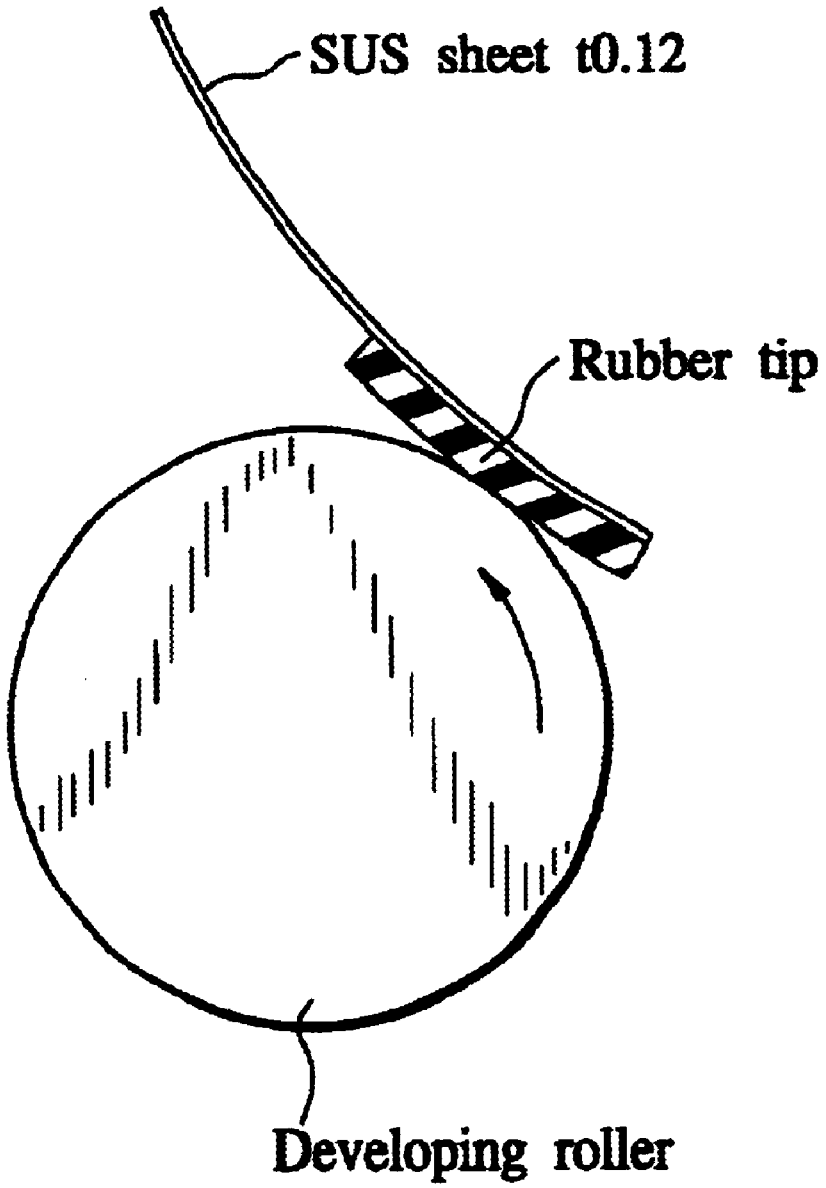
FIG. 9 is a diagram illustrating an arrangement in which a planar portion of a regulating blade is brought into contact with a developing roller.

In this embodiment, the rubber tip provided on the distal end of the regulating blade is brought into edge contact with the developing roller. However, the arrangement may be such that, as shown in FIG. 9, a urethane rubber member with a thickness of 2 mm is bonded to the distal end of a regulating blade formed from a SUS leaf spring of t0.12, and a planar portion of the rubber tip of the regulating blade is brought into contact with the developing roller. In this case also, a line-shaped uneven conveying surface can be formed in the same way as the above. In a case where a planar portion of the rubber tip of the regulating blade is brought into contact with the developing roller, the amount of toner conveyed by the developing member can be adjusted by controlling the contact load and the amount to which the distal end of the regulating blade projects from the contact position. To form a desired line-shaped uneven conveying surface, the volume resistivity of the urethane rubber on the distal end of the leaf spring should be not more than $10^9$ Ωcm. It is, however, desirable that the volume resistivity of the urethane rubber be not more than $10^6$ Ωcm.

As the supply roller, a urethane foam roller is placed in pressure contact with the developing roller and rotated in a direction against the direction of rotation of the developing roller with a constant circumferential speed ratio. The volume resistivity of the urethane foam should preferably be $10^5$ to $10^8$ Ωcm. If the volume resistivity is excessively high, the electric charge cannot follow effectively. Consequently, the desired supply bias effect cannot be obtained. An excessively low volume resistivity is not favorable because leakage would occur between the supply roller and the developing roller. In this embodiment, a urethane foam material with a volume resistivity of $10^7$ Ωcm is used.

The nip of contact between the urethane foam roller and the developing roller should preferably be 2 to 4.5 mm. If the contact nip is smaller than the above-described nip range, the toner supply force reduces undesirably. If the contact nip is larger than the above-described nip range, the torque required to drive the developing roller becomes undesirably large, causing image quality degradation. In this embodiment, the contact nip is set at 3.5 mm. The ratio of the circumferential speed of the urethane foam roller to that of the developing roller should preferably be 0.3 to 1 in a case where these roller rotate against each other. If the circumferential speed ratio is excessively low, the supply of toner becomes insufficient. If the circumferential speed ratio is excessively high, the driving toque increases, causing the image quality to be degraded. In this embodiment, the circumferential speed ratio is set at 0.53. The cell diameter of the urethane foam material should preferably be 10 to 50 times the volume-average particle size of the toner used. If the cell diameter is small relative to the volume-average particle size of the toner used, the cells of the urethane foam roller are undesirably clogged with toner particles, and the supply of toner becomes insufficient. If the cell diameter is large relative to the volume-average particle size of the toner used, brush marks due to the undesirably large cells appear in the developed image, causing image quality degradation. In this embodiment, a urethane foam material with a cell diameter of 120 μm, which is about 17 times the volume-average particle size 7 μm of the toner, is used.

The AC-superimposed bias voltage applied to the developing roller will be described below more specifically. The AC-superimposed bias voltage has a rectangular waveform, which is set so as to oscillate with respect to a set center value $V_{dc}$. The peak-to-peak voltage $V_{pp}$ may be set as desired. However, if the peak-to-peak voltage $V_{pp}$ is excessively small, the influence of electric potential variations with respect to the toner and the regulating blade reduces. Therefore, the AC-superimposed bias voltage has substantially no effect on the reduction of banding and longitudinal strip-shaped unevenness. If the peak-to-peak voltage VP is excessively large, charge injection occurs on the photosensitive member, causing the electrostatic latent image to be destroyed unfavorably. In contact development and non-contact development in which the development gap is not more than 0.5 mm, it is preferable to set the peak-to-peak voltage $V_{pp}$ so as to satisfy the following condition:

$$100V \leqq V_{pp} \leqq 3000V$$

In this embodiment, the peak-to-peak voltage $V_{pp}$ is set at 400 V, as has been stated in connection with FIG. 4. The AC-superimposed bias voltage applied to the developing roller is such a bias voltage as to oscillate in the range of 0 V to −400 V when the DC component $V_{dc}$ of the developing bias voltage is −200 V and in the range of +200 V to −200 V when the set center value $V_{dc}$ is 0 V. The frequency f of the AC-superimposed bias voltage may be set in correspondence to the secondary pitch frequency $f_{g2}$ of the developing roller driving gear. The pitch frequency of the developing roller driving gear may be calculated from the reciprocal of the period T of vibration calculated from the pitch n (mm) of the developing roller driving gear and the circumferential speed m (mm/s) as follows:

$$T = n/m$$

$$f_{g1} = 1/T$$

where n: gear pitch (mm);

m: image formation speed (mm/s)

The secondary pitch frequency $f_{g2}$ of the developing roller driving gear is double the gear pitch frequency $fg_1$.

In the image forming apparatus according to the present invention, the secondary pitch frequency $f_{g2}$ of the developing roller driving gear is 25.4 Hz, and the frequency f of the AC-superimposed bias voltage is set at 1 kHz. The line width of the line-shaped uneven conveying surface on the developing roller is determined by the frequency of the AC-superimposed bias voltage applied to the developing roller and the circumferential speed. In the image forming apparatus according to the present invention, the circumferential speed of the developing roller is 360 mm/s and the frequency of the AC-superimposed bias voltage applied to the developing roller is 1 kHz. Therefore, lines are formed on the developing roller in accordance with the electric potential variations such that the pitch is 0.36 mm and the line width is 0.18 mm, as shown in FIG. 4. The conveying surface formed on the developing roller may be judged by visual observation. More objectively, lines after the transfer to tape are measured with a microdensitometer (available from Abe Sekkei K.K.) several times, and an average of measured MTF values is obtained. If the average MTF value is 5 or more, the line configuration can be discerned.

However, it is desirable that the average MTF value be 10 or more. Simply, the MTF value may be calculated according to the following equation from a mean value $I_{on}$ of the maximum line density values and a mean value $I_{off}$ of the minimum inter-line density values obtained when five lines are measured.

$$\text{MTF value}=\{(I_{on}-I_{off})/(I_{on}+I_{off})\}\times 100$$

Figure 10:
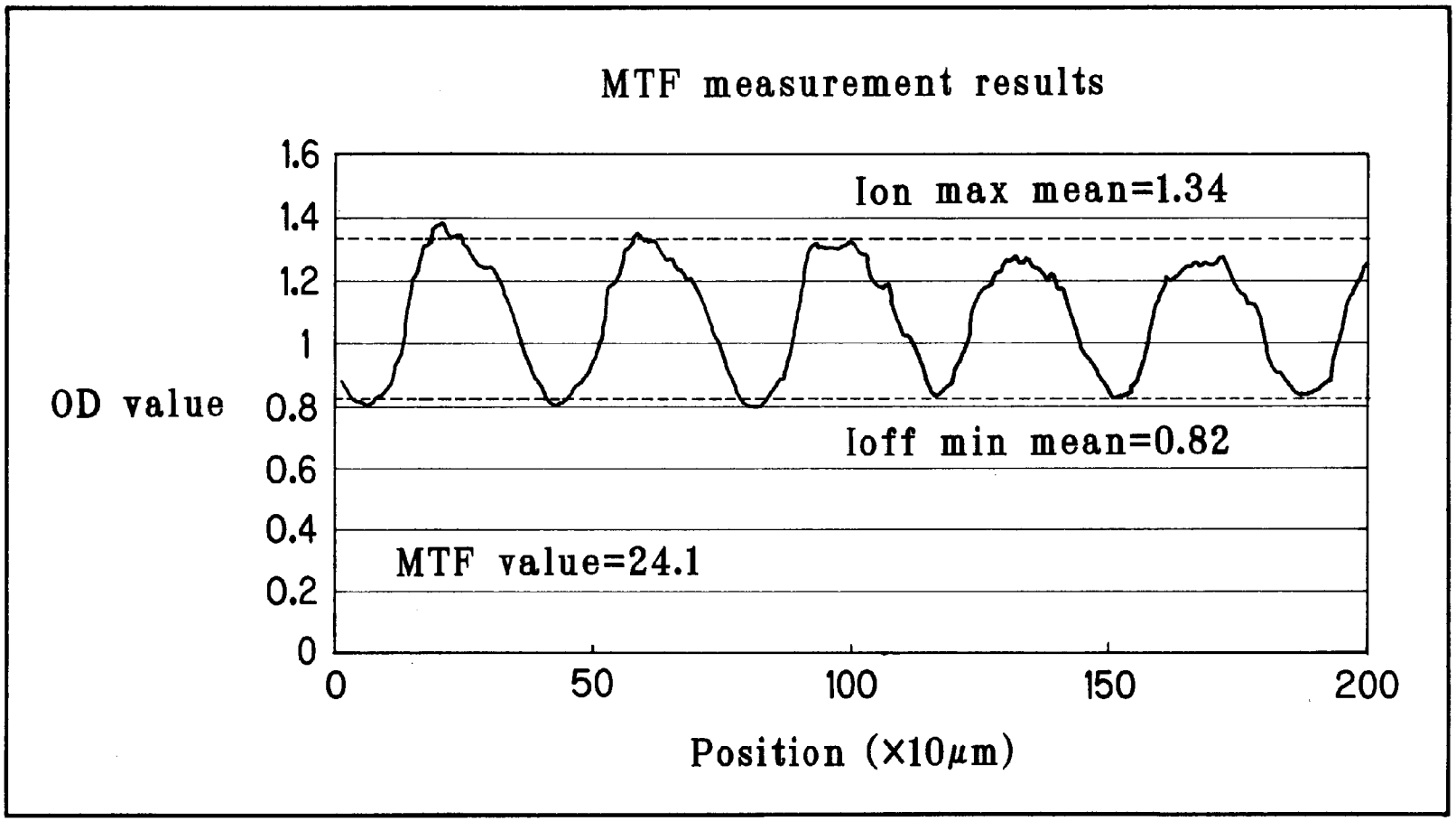
FIG. 10 is a diagram showing the results of MTF measurement of a line-shaped uneven conveying surface.

A thin toner layer was formed on the developing roller by using the developing device according to this embodiment in such a way that the developing roller was driven under application of the given bias voltage. As a result, a line-shaped conveying surface was formed. The line-shaped toner on the conveying surface was transferred to a piece of tape having a width of 12 mm with care taken not to disturb the line-shaped toner pattern. Then, the MTF value was measured with a microdensitomer. The measured MTF value was 24. The results of the MTF measurement are shown in FIG. 10. In this embodiment, image formation was performed by bringing the developing roller in and out of contact with a photosensitive member unit having a photosensitive layer formed on an Ni-electroformed belt as an elastic photosensitive member. It should be noted that the ratio of the circumferential speed of the photosensitive member to that of the developing roller was set to 1:2 to perform the developing operation. With this developing device, an entirely solid image and an entirely 40%-halftone image were formed. The formed images were uniform and free from density unevenness. Regarding longitudinal unevenness of density, density displacement was judged by visual observation and with a densitomer (X-Rite: 404) with the criterion standard that the density difference shall be within 0.2. The density difference of the entirely solid image was not more than 0.1. The density difference of the entirely 40% halftone image was not more than 0.05. Thus, the images were favorable in terms of longitudinal density unevenness. Density unevenness (banding) in the lateral direction of the images was not recognized by visual observation. Thus, the images were extremely favorable in terms of lateral density unevenness. Fogging was evaluated with the criterion standard that the amount of toner consumed when 1,000 sheets were continuously printed solid white shall be not more than 2 g. With the developing device of this embodiment, the amount of toner consumed was 0.5 g per 1,000 sheets printed solid white, which is a satisfactorily low level. Further, 100,000 sheets were continuously printed to evaluate printing durability. No filming was found on the developing roller. Even after printing 100,000 sheets, the developing device provided favorable images similar to those obtained in the early stages of printing.

By using the developing device of this embodiment, a DC voltage was applied to the developing roller as a developing bias voltage. When a DC voltage $V_{dc}$ of −200 V was applied, it was visually observed that the resulting image contained longitudinal strip-shaped unevenness and longitudinal stripes. The density difference in an entirely solid image was 0.45. The density difference in an entirely 40%-halftone image was 0.3. In addition, many banding defects, i.e. lateral density unevenness defects, were visually observed in the formed images. Thus, the image quality level was unfavorably low.

Figure 11:
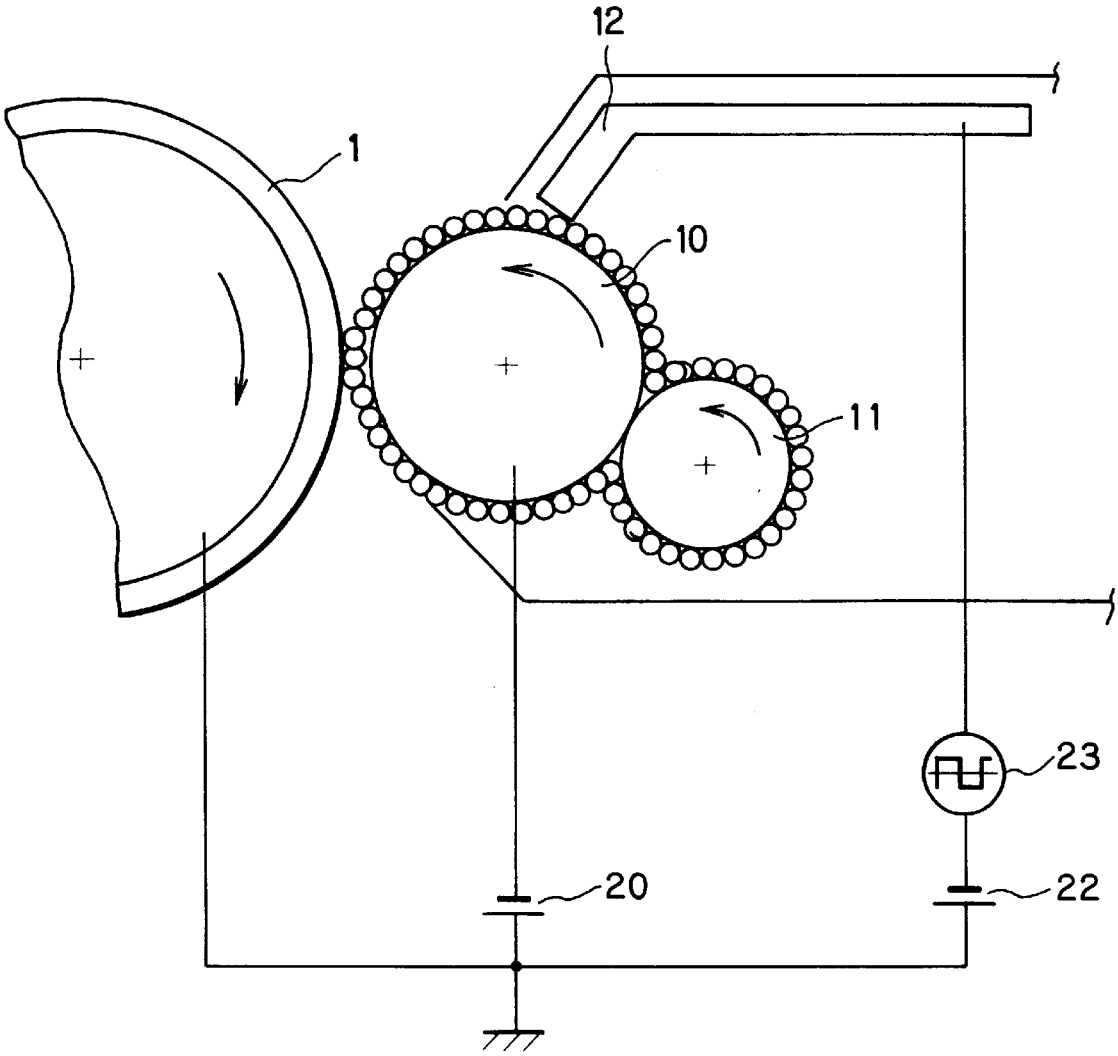
FIG. 11 is a diagram illustrating another example in which an AC-superimposed bias voltage is applied through a regulating blade.
Figure 12:
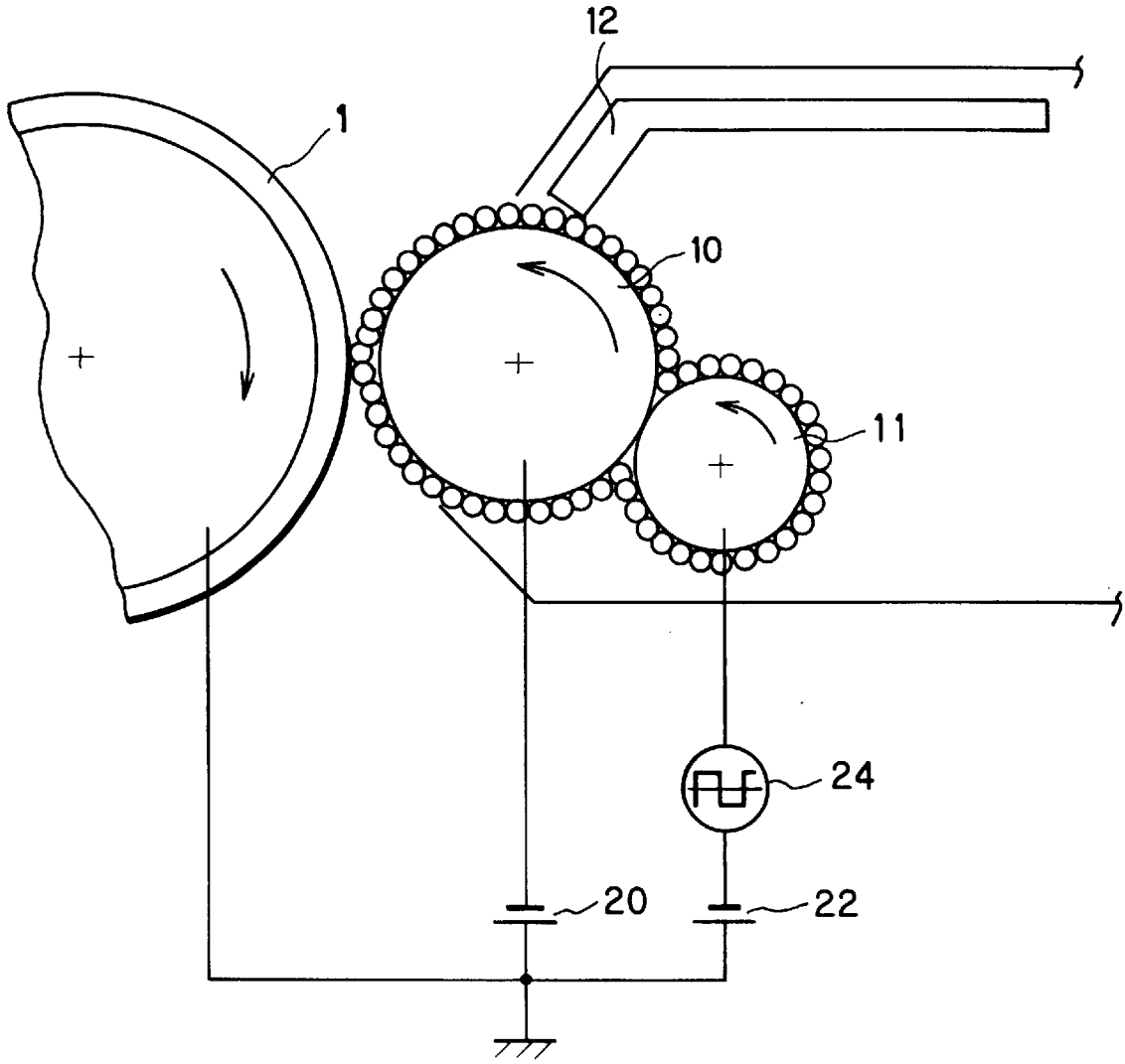
FIG. 12 is a diagram illustrating another example in which an AC-superimposed bias voltage is applied through a supply roller.
Figure 13:
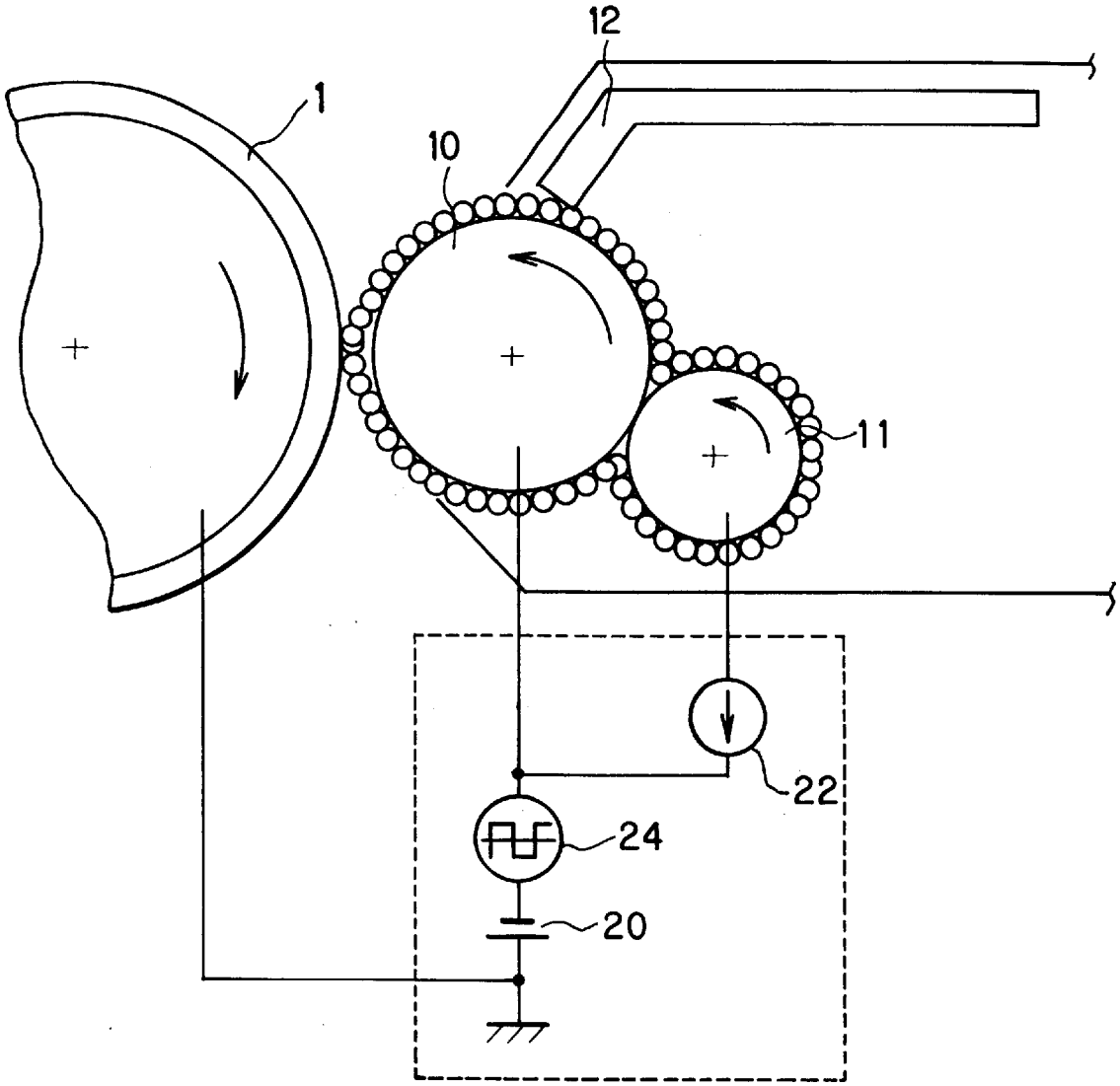
FIG. 13 is a diagram illustrating another example in which an AC-superimposed bias voltage is applied to a developing roller and a supply roller.

Although in the foregoing embodiment an AC-superimposed bias voltage is applied to the developing roller to cause electric potential variations, thereby forming a line-shaped uneven toner conveying surface. It should be noted, however, that the present invention is not necessarily limited thereto. It is also possible to form a conveying surface with a reduced height difference between the projection and recess patterns by controlling the frequency of the AC-superimposed bias voltage, the peak-to-peak voltage $V_{pp}$, the circumferential speed of the developing roller, etc. It is also possible to form a line-shaped uneven conveying surface by applying an AC bias voltage to the regulating blade 12 through an AC bias power source 23, as shown in FIG. 11 by way of example, so that the developing roller 10 and the regulating blade 12 are placed at the same electric potential, thereby causing electric potential variations. Further, a line-shaped uneven conveying surface may be formed on the developing roller by applying an AC-superimposed bias voltage to the supply roller 11 through an AC bias power source 24, as shown in FIG. 12. Alternatively, as shown in FIG. 13, an AC-superimposed bias voltage may be applied to the developing roller 10 and the supply roller 11, together with a constant-current bias applied therebetween, thereby forming a line-shaped uneven conveying surface on the developing roller 10. In the embodiment shown in FIG. 13, a constant-current bias power source is connected directly between the developing roller and the supply roller, thereby realizing high follow-up performance. Thus, in FIG. 13, a constant-current bias power source is connected in such a manner as to float on the AC-superimposed bias voltage applied to the developing roller to perform constant-current control between the developing roller and the supply roller. With this arrangement, it is possible to use a constant-current bias power source such as one that has substantially no capability of following the alternating current superimposed on the developing bias voltage. Formation of a line-shaped uneven conveying surface is favorable not only for non-contact development but also for contact development, as will be clear from FIG. 6, which shows that as the development gap is minimized, more favorable results are obtained. That is, it is possible to reduce filming, improve the lifetime, increase the toner development efficient and reproduce images faithfully by forming a line-shaped uneven conveying surface on the developing roller.

Figure 14:
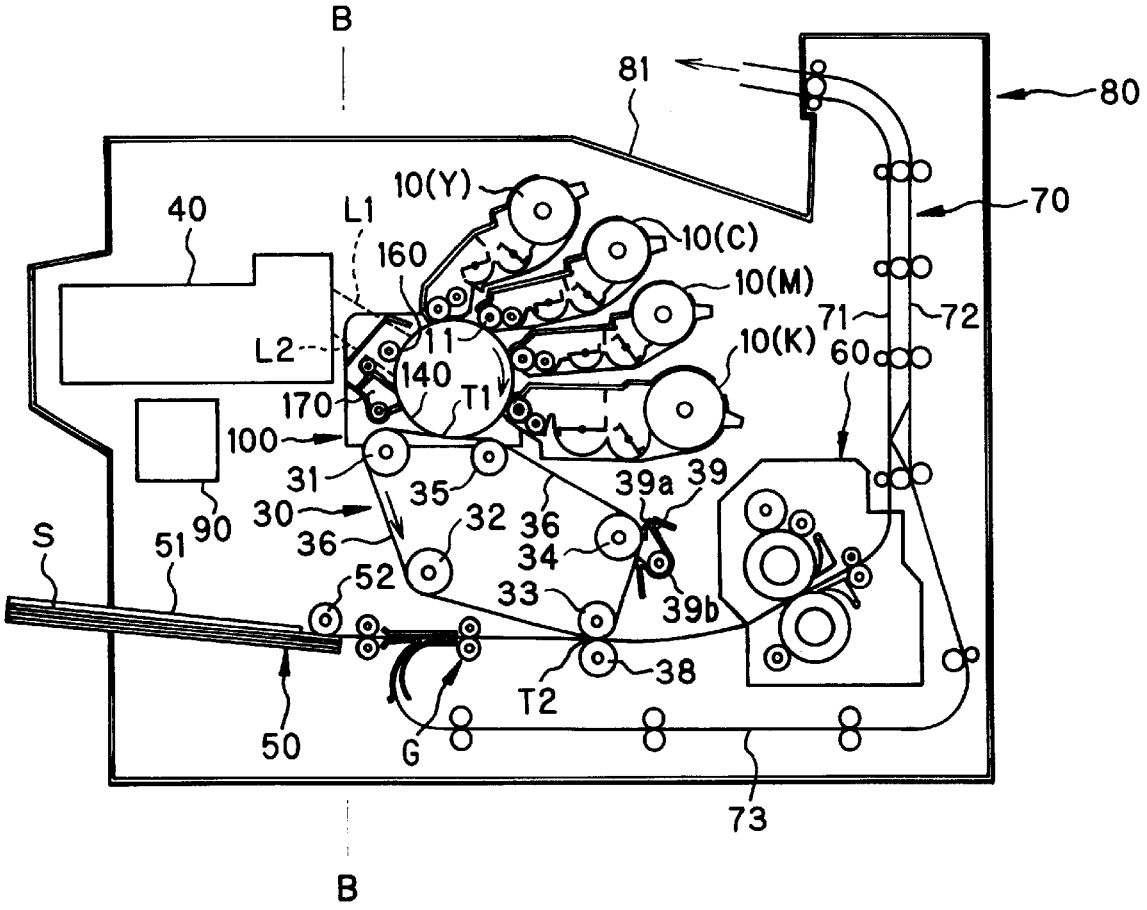
FIG. 14 is a diagram showing an embodiment of the image forming apparatus according to the present invention.

Next, the arrangement of the image forming apparatus according to the present invention will be described. FIG. 14 is a diagram showing an embodiment of the image forming apparatus according to the present invention. The image forming apparatus is capable of forming a full-color image by using developing units performing development with toners (developers) of four colors, i.e. yellow Y, cyan C, magenta M and black Bk.

In FIG. 14, an image carrier cartridge 100 incorporates an image carrier unit. In this embodiment, the image carrier cartridge 100 is constructed as a photosensitive member cartridge. A photosensitive member (latent image carrier) 140 is driven to rotate in the direction of the arrow shown in the figure by an appropriate driving device (not shown). The photosensitive member 140 has a thin-walled cylindrical electrically-conductive base material and a photosensitive layer formed on the surface of the base material. A charging roller 160 as a charging device, developing units 10 (yellow Y, cyan C, magenta M, and black Bk) as developing devices, an intermediate transfer device 30, and a cleaning device 170 are positioned around the photosensitive member 140 in the order mentioned in the direction of rotation of the photosensitive member 140.

Figure 18A:
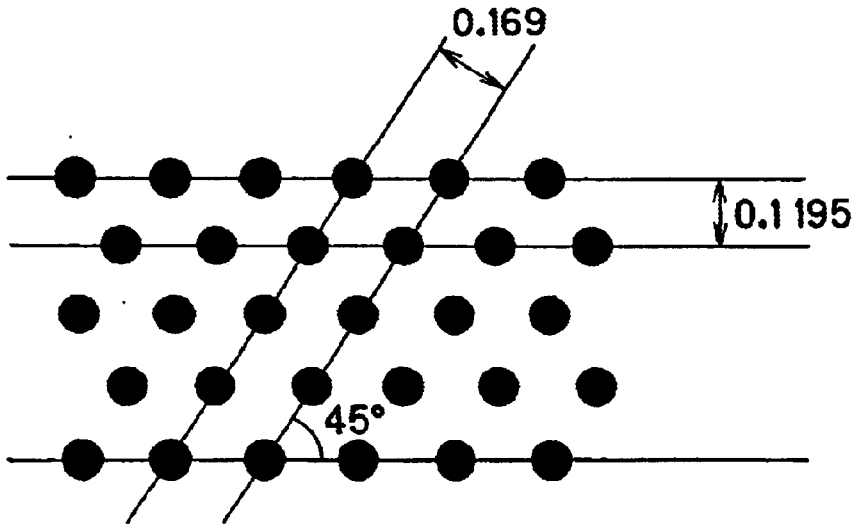
FIGS. 18*a* and 18*b* are diagrams showing an example of a screen
Figure 18B:
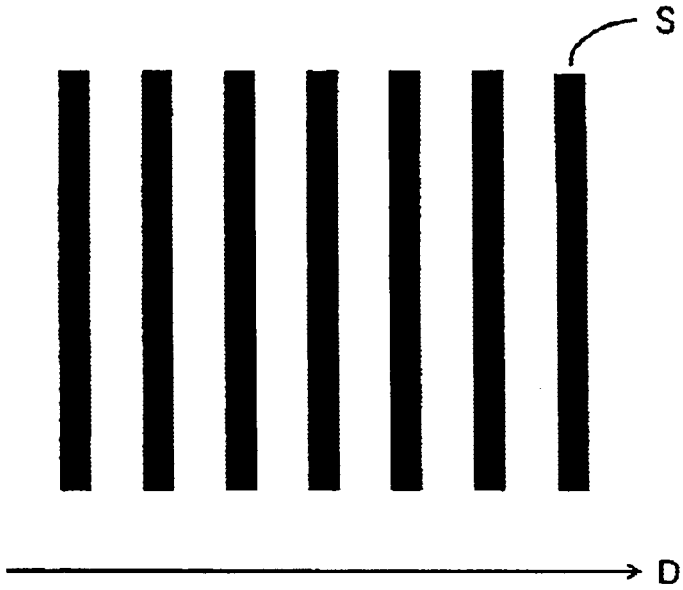

The charging roller 160 contacts the outer peripheral surface of the photosensitive member 140 to electrically charge the outer peripheral surface uniformly. The uniformly charged outer peripheral surface of the photosensitive member 140 is subjected to selective exposure L1 according to desired image information with an exposure unit 40 by performing image processing using, for example, as shown in FIG. 18(*a*), a 45-degree tilted halftone dot screen or as shown in FIG. 18(*b*), a vertical parallel-line screen formed from line segments S perpendicular to the scanning line D. By the exposure L1, an electrostatic latent image is formed on the photosensitive member 140. The electrostatic latent image is developed with toners given by the developing units 10.

As the developing units 10, a developing unit 10Y for yellow, a developing unit 10C for cyan, a developing unit 10M for magenta and a developing unit 10K for black are provided. These developing units 10Y, 10C, 10M and 10K are swingably constructed. A developing roller (developer carrier) 11 of only one developing unit can selectively contact the photosensitive member 140. Accordingly, these developing units 10 are arranged to apply one toner selected from yellow Y, cyan C, magenta M and black K to the surface of the photosensitive member 140 to develop the electrostatic latent image on the photosensitive member 140. The developing roller 11 is a rigid roller, e.g. a metal roller with a roughened surface. A line-shaped uneven conveying surface with longitudinally extending lines is formed on the developing roller 11 by application of an AC-superimposed bias voltage formed by superimposing an alternating current on a developing bias voltage.

The developed toner image is transferred to an intermediate transfer belt 36 of the intermediate transfer device 30. The cleaning device 170 has a cleaner blade for scraping off toner T remaining on the outer peripheral surface of the photosensitive member 140 after the transfer process. The cleaning device 170 further has a receiver for receiving toner scraped off by the cleaner blade.

The intermediate transfer device 30 has a driving roller 31, four driven rollers 32, 33, 34 and 35, and an endless intermediate transfer belt 36 stretched in such a manner as to pass around these rollers. The driving roller 31 has a gear (not shown) secured to an end thereof. The gear is in mesh with a gear 190 for driving the photosensitive member 140. Thus, the driving roller 31 is driven to rotate at approximately the same circumferential speed as that of the photosensitive member 140. Consequently, the intermediate transfer belt 36 is driven to circulate in the direction of the arrow shown in the figure at approximately the same circumferential speed as that of the photosensitive member 140.

The driven roller 35 is disposed at a position where the intermediate transfer belt 36 is pressed against the photosensitive member 140 between the driving roller 31 and the driven roller 35 by tension acting on the intermediate transfer belt 36. A primary transfer portion T1 is formed at a position where the intermediate transfer belt 36 is pressed against the photosensitive member 140. The driven roller 35 is positioned near the primary transfer portion T1 at the upstream side thereof in the direction of circulation of the intermediate transfer belt 36.

An electrode roller (not shown) is positioned to face the driving roller 31 across the intermediate transfer belt 36. A primary transfer voltage is applied to the electrically-conductive layer of the intermediate transfer belt 36 through the electrode roller. The driven roller 32 is a tension roller that urges the intermediate transfer belt 36 with an urging device (not shown) in a direction in which the intermediate transfer belt 36 is stretched under tension. The driven roller 33 is a backup roller for forming a secondary transfer portion T2. A secondary transfer roller 38 is positioned to face the backup roller 33 across the intermediate transfer belt 36. A secondary transfer voltage is applied to the secondary transfer roller 38. The secondary transfer roller 38 is capable of being brought into and out of contact with the intermediate transfer belt 36 by a secondary transfer roller advancing and retracting mechanism (not shown). The driven roller 34 is a backup roller for a belt cleaner 39. The belt cleaner 39 has a cleaner blade 39*a* that is brought into contact with the intermediate transfer belt 36 to scrape off toner remaining on the outer peripheral surface of the intermediate transfer belt 36. The belt cleaner 39 further has a receiver 39*b* for receiving toner scraped off by the cleaner blade 39*a*. The belt cleaner 39 is capable of being brought into and out of contact with the intermediate transfer belt 36 by a belt cleaner advancing and retracting mechanism (not shown).

The intermediate transfer belt 36 is a double-layer belt having an electrically-conductive layer and a resistance layer formed on the electrically-conductive layer so as to be pressed against the photosensitive member 140. The electrically-conductive layer is formed on an electrical insulating substrate made of a synthetic resin material. The primary transfer voltage is applied to the electrically-conductive layer through the above-described electrode roller. It should be noted that the resistance layer is stripped longitudinally at a side edge of the intermediate transfer belt 36 to expose the electrically-conductive layer in a strip-like pattern. The electrode roller contacts the exposed portion of the electrically-conductive layer.

In the course of the circular movement of the intermediate transfer belt 36, the toner image on the photosensitive member 140 is transferred to the intermediate transfer belt 36 at the primary transfer portion T1. The toner image transferred to the intermediate transfer belt 36 is transferred to a sheet (recording medium) S, e.g. paper, fed between the intermediate transfer belt 36 and the secondary transfer roller 38 at the secondary transfer portion T2. The sheet S is transported from a sheet feeder 50 and fed to the secondary transfer portion T2 at a predetermined timing by a gate roller pair G. Reference numeral 51 denotes a sheet cassette. Reference numeral 52 denotes a pickup roller.

The sheet S to which the toner image has been transferred at the secondary transfer portion T2 passes through a fixing unit 60, whereby the toner image is fixed. Then, the sheet S passes through a delivery path 70 and is discharged onto a sheet delivery tray 81 formed on a casing 80 of the apparatus body. It should be noted that the image forming apparatus has two independent delivery paths 71 and 72 as the delivery path 70. The sheet S passing through the fixing unit 60 is discharged through either the delivery path 71 or 72. The delivery paths 71 and 72 also constitute a switchback path. When images are to be formed on both sides of a sheet, the sheet once entering the delivery path 71 or 72 is transported toward the secondary transfer portion T2 through a return path 73.

The following is a summary of operations taking place throughout the above-described image forming apparatus. An AC-superimposed bias voltage is applied to the roller in each developing unit to form a line-shaped uneven conveying surface. At the exposure unit, image processing is performed by using a vertical parallel-line screen or setting the relationship between the pitch of the line-shaped uneven conveying surface and the dot pitch in the feed direction of a screen used in the exposure unit so that the pitch of the line-shaped uneven conveying surface is not an integral multiple nor quotient of the dot pitch in the feed direction of the screen.

(1) When a print command signal (image forming signal) is inputted to a control unit 90 of the image forming apparatus from a host computer or the like (e.g. a personal computer), which is not shown in the figure, the photosensitive member 140, the roller 11 in each developing unit 10 and the intermediate transfer belt 36 are driven to rotate.

(2) The outer peripheral surface of the photosensitive member 140 is uniformly electrically charged by the charging roller 160.

(3) The uniformly charged outer peripheral surface of the photosensitive member 140 is subjected to selective exposure L1 corresponding to image information concerning a first color (e.g. yellow) with the exposure unit 40 by performing image processing using a vertical parallel-line screen or a 45-degree tilted halftone dot screen. Thus, an electrostatic latent image for yellow is formed on the photosensitive member 140.

(4) Only one developing roller for the first color, for example, the developing roller of the developing unit 10Y for yellow, comes in contact with the photosensitive member 140 to develop the above-described electrostatic latent image. Thus, a toner image of yellow as the first color is formed on the photosensitive member 140.

(5) A primary transfer voltage opposite in polarity to the charge of the toner is applied to the intermediate transfer belt 36. The toner image formed on the photosensitive member 140 is transferred to the intermediate transfer belt 36 at the primary transfer portion T1. At this time, the secondary transfer roller 38 and the belt cleaner 39 are separate from the intermediate transfer belt 36.

(6) Toner remaining on the photosensitive member 140 is removed by the cleaning device 170. Thereafter, the photosensitive member 140 is destaticized by destaticizing light L2 from a destaticizing device.

(7) The above-described operations (2) to (6) are repeated according to need. That is, according to the contents of the print command signal, the operations are repeated for a second color, a third color and a fourth color, whereby toner images corresponding to the contents of the print command signal are superimposed on one another on the intermediate transfer belt 36.

(8) A sheet S is transported from the sheet feeder 50 at a predetermined timing. Immediately before the leading end of the sheet S reaches the secondary transfer portion T2 or after it has reached the secondary transfer portion T2 (i.e. at the timing when the toner image on the intermediate transfer belt 36 is transferred to a desired position on the sheet S), the secondary transfer roller 38 is pressed against the intermediate transfer belt 36, and at the same time, a secondary transfer voltage is applied to the secondary transfer roller 38, whereby the toner image (basically, a full-color image formed from toner images of four colors superimposed on one another) on the intermediate transfer belt 36 is transferred to the sheet S. In addition, the belt cleaner 39 is brought into contact with the intermediate transfer belt 36 to remove toner remaining on the intermediate transfer belt 36 after the secondary transfer process.

(9) The sheet S passes through the fixing unit 60, thereby fixing the toner image on the sheet S. Thereafter, the sheet S is conveyed toward a predetermined position (toward the sheet delivery tray 81 in the case of single-side printing; toward the switchback path 71 or 72 in the case of double-side printing).

Figure 15A:
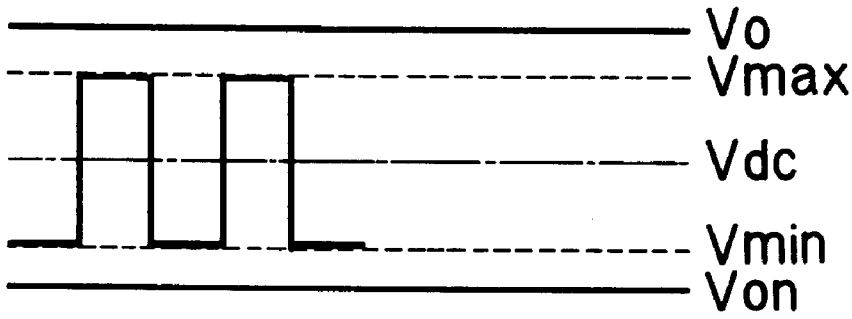
FIGS. 15(*a*) and 15(*b*) are diagrams for describing an AC-superimposed bias voltage.
Figure 15B:
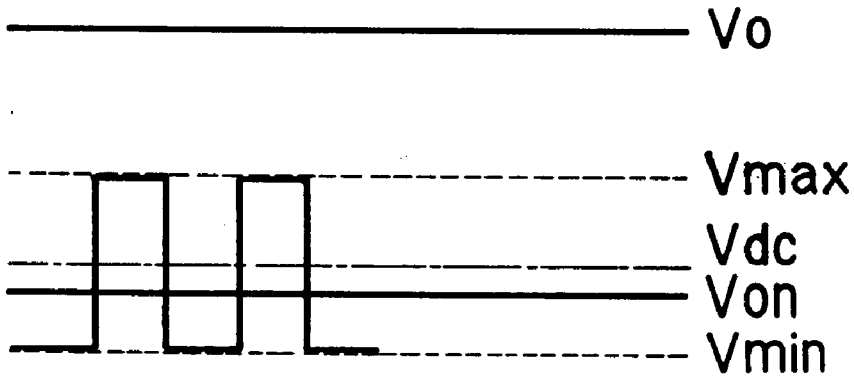
Figure 16:
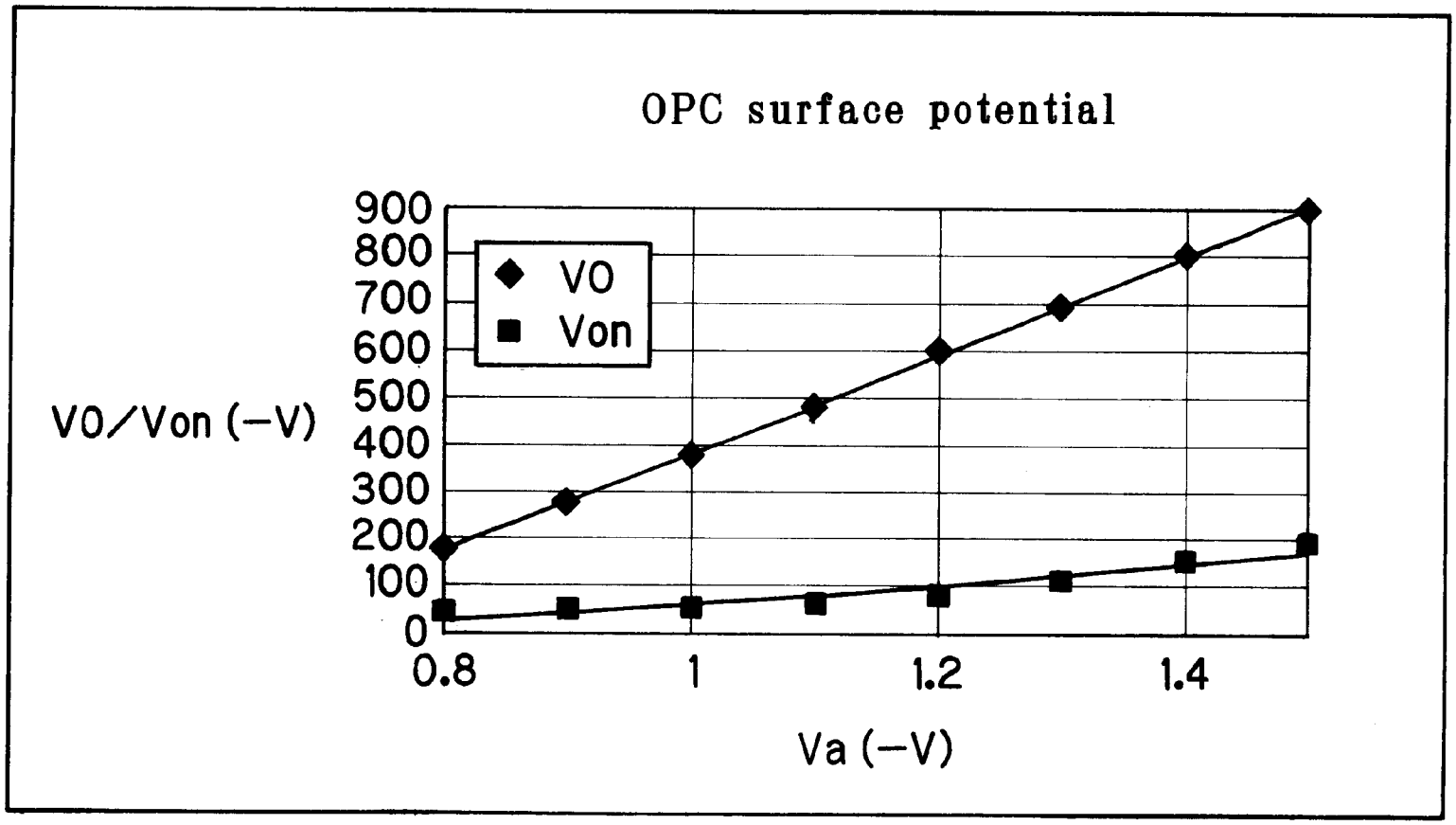
FIG. 16 is a diagram for describing the relationship between a DC bias voltage applied to a charging roller and the surface potential of a latent image carrier.
Figure 17:
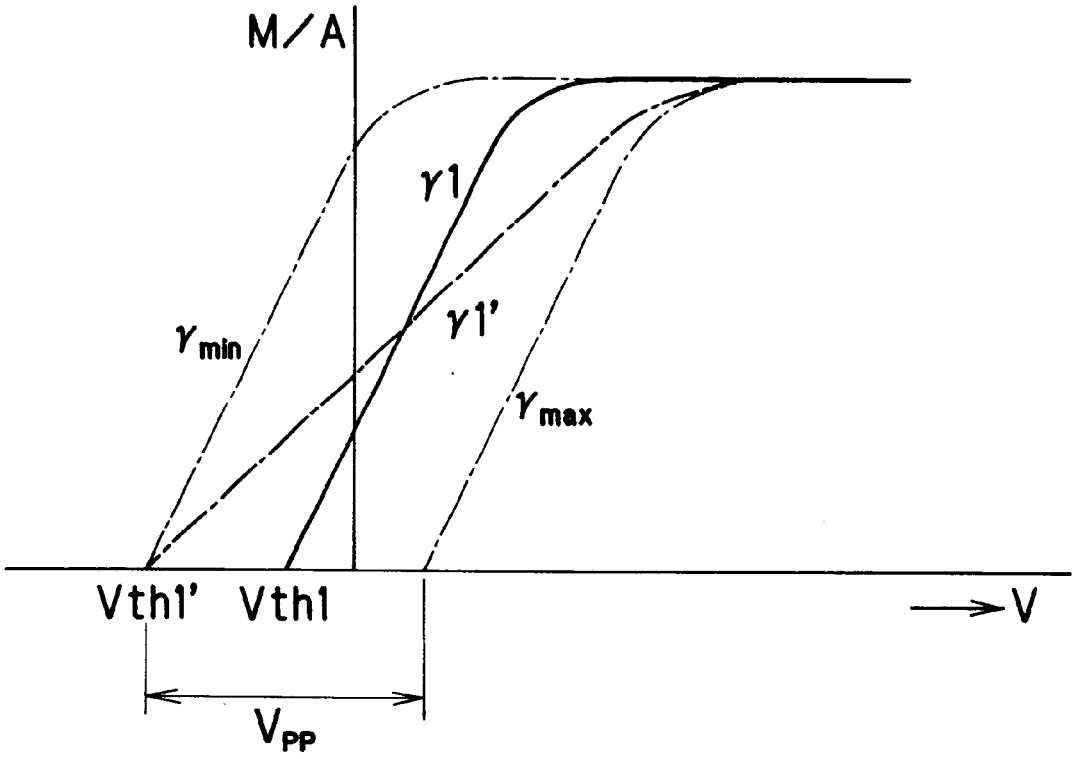
FIG. 17 is a diagram for describing the relationship between development characteristics γI, AC-superimposed bias peak-to-peak voltage $V_{pp}$ and threshold value $V_{th}$.

FIG. 15 is a diagram for describing the AC-superimposed bias voltage applied to the developing roller in the developing unit. FIG. 16 is a diagram showing the relationship between the DC bias voltage applied to the charging roller and the surface potential of the photosensitive member. FIG. 17 is a diagram for describing the relationship between development γ, AC-superimposed bias peak-to-peak voltage $V_{pp}$, and threshold value $V_{th}$.

The AC-superimposed bias voltage to be applied to the developing roller is, for example, set so that the maximum value $V_{max}$ is smaller than the charge potential $V_0$ of the photosensitive member 1, or the minimum value $V_{min}$ of the AC-superimposed bias voltage is higher than the exposure potential $V_{on}$ of the photosensitive member 1 by controlling the DC bias voltage $V_{dc}$ or the peak-to-peak voltage $V_{pp}$ ($=V_{max}-V_{min}$) of the AC bias voltage. For example, when $V_{pp}$ is set at 400V and $V_{dc}$ is set at −200V, the bias voltage ranges from 0V to −400V. When $V_{dc}$ is set at 0V, the bias voltage ranges from +200V to −200V.

In one example of the above-described bias voltages, the DC bias voltage $V_a$ to be applied to the charging roller is set at −200V, so that the charge potential $V_0$ of the photosensitive member 1 is set at −600V and the exposure potential $V_{on}$ is set at −30V. Meanwhile, the maximum value $V_{max}$ of the developing bias voltage (AC-superimposed bias voltage) is set at −500V or more and the minimum value $V_{min}$ is set at −100 or less. Thus, the peak-to-peak voltage $V_{pp}$ is controlled to 400V, and the DC bias voltage $V_{dc}$ to −300V. As a power source for an AC-superimposed bias voltage to be applied to the developing roller 2, a relatively inexpensive, simple power circuit can realize a rectangular wave of duty 50%. The duty is also changeable as desired.

When the maximum value $V_{max}$ of the AC-superimposed bias voltage is set lower than the charge potential $V_0$ of the photosensitive member 1 and the minimum value $V_{min}$ of the AC-superimposed bias voltage is set so as to exceed the exposure potential $V_{on}$ as shown in part (a) of FIG. 15, toner adheres to the image area on the photosensitive member 1 according to the direction of the electric field. In this case, toner does not separate from the photosensitive member 1 to return to the developing roller 2 because the direction of the electric field from the photosensitive member 1 toward the developing roller 2 does not change. Adhesion of toner does not occur in the non-image area.

On the other hand, when the minimum value $V_{min}$ of the AC-superimposed bias voltage is lower than the exposure potential $V_{on}$ as shown in part (b) of FIG. 15, toner adheres to the image area on the photosensitive member 1 according to the direction of the electric field. However, at a region where the exposure potential $V_{on}$ and the minimum value $V_{min}$ of the AC-superimposed bias voltage are inverted relative to each other, toner is separated from the photosensitive member 1 to return to the developing roller 2. Therefore, toner adhering to the image area to excess is separated moderately. Accordingly, it is possible to reduce density unevenness and defacement of the image. At the non-image area, adhesion of toner does not occur as in the case of part (a) of FIG. 15.

The peak-to-peak voltage $V_{pp}$ and the DC bias voltage $V_{dc}$ can be set as desired within the limits for the maximum value $V_{max}$ of the AC-superimposed bias voltage. Therefore, either of the above-described situations occurs according to how the peak-to-peak voltage $V_{pp}$ and the DC bias voltage $V_{dc}$ are set. In either case, no toner adheres to the non-image area. Accordingly, it is possible to form a favorable image free from background fogging.

The charge potential $V_0$ of the photosensitive member OPC can be measured with a surface potentiometer (e.g. Model 1344: available from TREK). The charge potential $V_0$ varies with the DC bias voltage $V_a$ applied to the charging roller. FIG. 16 is a graph showing the relationship between the DC bias voltage $V_a$ and the surface potentials $V_0$ and $V_{on}$ Thus, the surface potentials $V_0$ and $V_{on}$ can be determined by setting the DC bias voltage $V_a$, and the DC bias voltage $V_{dc}$, the peak-to-peak voltage $V_{pp}$ and the DC bias voltage $V_a$ can be set as desired. Therefore, the DC bias voltage $V_a$ can be set, for example, as follows. The toner density on the intermediate transfer medium is detected, and thereafter, a DC bias voltage $V_{dc}$ and a peak-to-peak voltage $V_{pp}$ with which the desired density can be obtained are set. The DC bias voltage $V_a$ is set from the relation of $V_0-V_a$ for which data entry has been made in advance according to the values of the set DC bias voltage $V_{dc}$ and peak-to-peak voltage $V_{pp}$.

In FIG. 17, the abscissa axis represents the electric potential V, and the ordinate axis represents the toner adhesion density. The characteristic curve showing development γ1' effected with the AC-superimposed bias voltage having the peak-to-peak voltage $V_{pp}$ slopes gently in comparison to the characteristic curve showing development γ1 effected with the DC bias voltage $V_{dc}$. Thus, gradation characteristics are improved. Let us assume that $Y_{min}$ represents development effected with a DC bias voltage set equal to the minimum value $V_{min}$ of the AC-superimposed bias voltage, and $\gamma_{max}$ represents development effected with a DC bias voltage set equal to the maximum value $V_{max}$ of the AC-superimposed bias voltage. If development is effected under application of an AC-superimposed bias voltage with this amplitude, the characteristic curve slopes between the two curves as shown in the figure. Accordingly, the development characteristic curve slopes move gently as the amplitude increases. In other words, development γ1' effected with the AC-superimposed bias voltage depends on the magnitude of the peak-to-peak voltage $V_{pp}$ of the AC-superimposed bias voltage, and the electric potential at which the development characteristic curve γ rises, i.e. the threshold value $V_{th1}$, shifts toward $V_{th1'}$ by an amount corresponding to an increase in the magnitude of the peak-to-peak voltage $V_{pp}$. It should be noted that the threshold values $V_{th1}$ and $V_{th1'}$ are bias voltage values at which toner begins to adhere. Accordingly, if the bias voltage is set lower than the threshold values $V_{th1}$ and $V_{th'}$ adhesion of toner does not take place. When the bias voltage exceeds the threshold value $V_{th1}$ or $V_{th1'}$ adhesion of toner occurs. The degree of toner adhesion increases as the extent to which the bias voltage exceeds the threshold value increases. As will be clear from this, it is necessary to set the bias voltage lower than at least the threshold value in order to minimize fogging and to enhance the toner separating effect. Moreover, the threshold value can be shifted not only by changing the DC bias voltage $V_{dc}$ but also by changing the peak-to-peak voltage $V_{pp}$ of the AC-superimposed bias voltage.

Any vertical parallel-line screen is usable regardless of the number of lines of the screen. However, as the number of lines increases and the resolution increases, noise such as banding becomes more conspicuous in the printed image. Therefore, the number of lines necessary for attaining the desired printed image is selected.

It is also possible to use a screen obtained by tilting the line segments of a vertical parallel-line screen slightly (15° or less) with respect to the direction of the scanning line. In this case, it is necessary to use a screen having smooth lines. If there is some noise (unevenness or thickening of lines) in the feed direction, when the AC bias voltage is varied, density unevenness may be produced by synchronization with the noise. Therefore, such a screen cannot be used.

In the image forming apparatus according to the present invention, it is possible to employ a conventional image processing method for reproducing a halftone image using a dither method or a density pattern method. Therefore, image formation was carried out, by way of example, with a screen having a halftone dot structure 450 tilted with respect to the scanning line direction by using a laser write system with a resolution of 600 dpi. Part (a) of FIG. 18 shows an example of a screen having a halftone dot structure. After an electrostatic latent image had been formed on the photosensitive member by using such a latent image forming system, an AC-superimposed bias voltage was applied to the developing roller to form a solid image and an entirely 40%-halftone image. At that time, as shown in part (b) of FIG. 18, the dot period in the feed direction was 0.1195 mm, and the process speed (sheet feed speed) was 180 mm/s. The frequency $f_s$ was 1506 Hz. The frequency $f_{ac}$ of the AC-superimposed bias voltage applied to as a developing bias voltage was set to a frequency other than those obtained by multiplying the frequency $f_s$ by n and by 1/n, i.e. 1700 Hz by way of example. As a result, density unevenness in the feed direction, i.e. banding, did not occur. Further, the frequency $f_{ac}$ of the AC-superimposed bias voltage applied as a developing bias voltage was continuously varied. Banding occurred at 753 Hz, 502 Hz, 377 Hz and 301 Hz, which approximately correspond to 1/n of 1506 Hz, and at 1506 Hz, 3012 Hz and 4518 Hz, which correspond to n times as high as 1506 Hz. In the other frequency regions, no banding was observed by visual inspection. Thus, favorable images were obtained.

The image forming apparatus according to the present invention is arranged so that the frequency $f_{ac}$ of the AC-superimposed bias voltage is not synchronized to the frequency of lateral unevenness generated mechanically. Banding due to the application of an AC-superimposed bias voltage occurs particularly when the frequency $f_{ac}$ of the AC-superimposed bias voltage synchronizes to the frequency of mechanical irregularities due to the drive of the developing device. The reason for this is as follows. Banding that has already occurred in the electrostatic latent image on the photosensitive member cannot be eliminated no matter how faithfully the development process is carried out. Even if there is no banding in the toner image on the photosensitive member, it is impossible to avoid banding that occurs undesirably in the transfer or fixing process. Because the developing device uses a plurality of gears to transmit driving force, it is necessary to make the frequency $f_{ac}$ of the AC-superimposed bias voltage asynchronous to the frequency arising from synchronization of gears, not to mention each individual gear. However, it is possible to determine a gear that causes banding to appear most strongly in the image. Therefore, it is possible to make banding inconspicuous and to form a favorable image by designing the system so that the frequency $f_{ac}$ of the AC-superimposed bias voltage is asynchronous to a gear that causes particularly strong banding If the developing roller driving gear causes banding to occur most strongly, the frequency $f_{ac}$ of the AC-superimposed bias voltage may be set in correspondence to the secondary pitch frequency $f_{g2}$ of the developing roller driving gear. The secondary pitch frequency $f_{g2}$ of the developing roller driving gear is a value double the gear pitch frequency $f_{g1}$, which indicates the influence of banding occurring mainly when the gear shaft is decentered. The frequency $f_{ac}$ of the AC-superimposed bias voltage should preferably be greater than the secondary pitch frequency, not to mention the primary pitch frequency. For example, when n=1.05 mm and v=360 mm/s, $f_{g1}$=362.9 Hz, and $f_{g2}$=685.7 Hz. Therefore, to make the frequency $f_{ac}$ of the AC-superimposed bias voltage asynchronous to the gear, the frequency $f_{ac}$ should be designed to be a frequency other than those obtained by multiplying the frequency $f_{g2}$ by n and by 1/n. If the frequency $f_{ac}$ of the AC-superimposed bias voltage is set at 1000 Hz, for example, the occurrence of banding can be avoided.

Similarly, in the case of the photosensitive member driving gear, if n=1.2 mm and v=180 mm/s, $f_{g3}$=150 Hz. Therefore, to make the frequency $f_{ac}$ of the AC-superimposed bias voltage asynchronous to the gear, the frequency $f_{ac}$ should be set at 980 Hz, for example. If a frequency $f_{gn}$ arising from another gear appears strongly as banding in the image, the frequency $f_{ac}$ of the AC-superimposed bias voltage should be varied so that the line-shaped uneven conveying surface on the developing roller is asynchronous to the gear. By doing so, the occurrence of banding can be avoided.

It should be noted that the present invention is not necessarily limited to the foregoing embodiments but can be modified in a variety of ways. For example, although in the foregoing embodiment, banding unevenness is prevented by a combination of a line-shaped uneven conveying surface on the developing roller and a vertical parallel-line screen, it is also possible to form a line-shaped uneven conveying surface by controlling the frequency of the AC-superimposed bias voltage so that it is also possible to reduce banding unevenness due to mechanical vibrations and other natural vibrations of mechanical elements. In this case, for example, the frequency of an alternating current to be superimposed on the developing bias voltage is set so as not to be an integral multiple of the frequency of mechanical vibrations.

Regarding the screen structure, although a 45-degree tilted halftone dot screen is used in the foregoing embodiment, it is also possible to use a halftone dot screen tilted at any desired angle to the scanning direction, a horizontal parallel-line screen, and a hybrid parallel-line screen (a combination of a vertical parallel-line screen and a halftone dot screen). In this case also, the frequency $f_{ac}$ of the AC-superimposed bias voltage should be changed in accordance with the calculated frequency in the feed direction. Further, because the screen structure and the number of lines of the screen, which indicates resolution, can be selected as desired by design, it is also possible to change the frequency $f_{ac}$ of the AC-superimposed bias voltage after the screen structure and the resolution have been determined as stated above. It is also possible to change image processing conditions after the determination of the AC-superimposed bias voltage and the designing of the power source in the reverse relation to the above.

Further, in the foregoing embodiment, the frequency $f_{ac}$ of the AC-superimposed bias voltage is set at a frequency other than those obtained by multiplying the determined gear pitch frequency by n and by 1/n. However, the frequency $f_{ac}$ of the AC-superimposed bias voltage may also be set to a frequency that is asynchronous to the measured pitch of composite banding defects actually appearing in the image owing to various factors, including banding due to the screen structure.

As has been stated above, according to the present invention, a line-shaped uneven conveying surface is formed on the surface of the developing roller to make image force unlikely to act. Accordingly, even small toner particles, which have a large toner charge quantity q/m, can readily leave the developing roller. Consequently, it is possible to reduce the residual factor of small toner particles remaining on the developing roller surface and to thereby reduce the occurrence of selective development by the consumption of small toner particles. Thus, the development efficiency can be increased. In addition, stable development characteristics can be obtained over a long period of time without the occurrence of filming. Accordingly, it is possible to increase the lifetime of the system. Moreover, toner can be electrically charged satisfactorily even when the toner layer thickness is increased. Thus, it is possible to form a line-shaped uneven conveying surface with a stabilized and increased toner layer thickness. In addition, fogging is unlikely to occur. Therefore, a favorable image can be obtained.

During development, mechanical scraping force acts at portions where the abundance probability density of toner particles is high, and excess toner can be scraped off. Consequently, the image quality is improved. Moreover, excess toner adhering to the trailing end is mechanically scraped off, thereby making it possible to reduce the increase in density at the trailing end. Accordingly, undesired tailing is not produced.

Further, the influence of the irregularity of feeding by the driving gear is reduced, and the packing of the toner in the development nip is minimized, thereby increasing the degree of freedom with which toner particles are movable, and faithfully reproducing the latent image to obtain a favorable image free from noise. In addition, fogging and scattering are minimized. Moreover, the occurrence of clogging with aggregates of toner is reduced, and longitudinal strip-shaped unevenness and longitudinal stripes are eliminated. Thus, it becomes possible to attain high image quality and to increase the lifetime of the system.

By performing image processing using a vertical parallel-line screen, a component synchronizing to the line-shaped uneven conveying surface is eliminated. Therefore, banding can be reduced even more effectively. Further, the pitch of the line-shaped uneven conveying surface formed by application of an AC-superimposed bias voltage is set so as not to be an integral multiple nor quotient of the dot pitch in the feed direction of the screen, and a 45-degree tilted halftone dot screen, a horizontal parallel-line screen or a hybrid parallel-line screen is used as a screen structure, whereby the line-shaped uneven conveying surface formed on the developing roller becomes asynchronous to the frequency of vibrations or feed irregularities contributing to the occurrence of density unevenness in the feed direction. Thus, banding can be reduced effectively.

What we claim is:

1. An image forming apparatus comprising:

a latent image carrier on which a latent image is formed;

a developer carrier for conveying a one-component non-magnetic developer and for developing the latent image in close proximity to said latent image carrier;

voltage application means for applying an AC-superimposed bias voltage to said developer carrier; and a regulating member abutting against said developer carrier to regulate a thickness of a developer layer on said developer carrier, wherein the developer layer is formed with a line-shaped uneven conveying surface by said AC-superimposed bias voltage applied thereto, and wherein said regulating member has a semiconductive member provided at a distal end thereof to produce an electric potential difference between said semiconductive member and said developer carrier, to which said AC-superimposed bias voltage is applied, when regulating the thickness of the developer layer on said developer carrier.

2. An image forming apparatus comprising:

a latent image carrier on which a latent image is formed;

a developer carrier for conveying a one-component non-magnetic developer and for developing the latent image in contact with said latent image carrier;

voltage application means for applying an AC-superimposed bias voltage to said developer carrier; and a regulating member abutting against said developer carrier to regulate a thickness of a developer layer on said developer carrier;

wherein said regulating member has a semiconductive member provided at a distal end thereof to produce an electric potential difference between said semiconductive member and said developer carrier, to which said AC-superimposed bias voltage is applied, when regulating the thickness of the developer layer on said developer carrier.

3. The image forming apparatus of claim 2, wherein the developer layer on said developer carrier is formed with a line-shaped uneven conveying surface by said AC-superimposed bias voltage applied thereto.

4. The image forming apparatus of claim 1 or 2, wherein said regulating member has a rubber tip attached to a distal end of a metal plate as said semiconductive member.

5. The image forming apparatus of claim 1 or 2, wherein said regulating member has a rubber tip with a volume resistivity of not more than $10^9$ Ωcm as said semiconductive member.

6. The image forming apparatus of claim 1 or 2, wherein said regulating member has a rubber tip with a hardness of 55 to 80 degrees according to JIS A as said semiconductive member.

7. The image forming apparatus of claim 1 or 2, wherein said regulating member has a urethane rubber tip as said semiconductive member.

8. The image forming apparatus of claim 1 or 2, wherein said regulating member abuts against said developer carrier at an edge thereof.

9. The image forming apparatus of claim 1 or 2, wherein said regulating member is placed at a floating potential or a ground potential or a constant potential.

10. The image forming apparatus of claim 1 or 2, wherein a frequency of said AC-superimposed bias voltage is greater than a pitch vibration frequency of a gear for driving said developer carrier.

11. The image forming apparatus of claim 1 or 2, wherein a frequency f of said AC-superimposed bias voltage is not lower than 200 Hz.

12. The image forming apparatus of claim 1 or 2, wherein a frequency f of said AC-superimposed bias voltage is not higher than 8 kHz.

13. The image forming apparatus of claim 1 or 2, wherein said AC-superimposed bias voltage is a rectangular wave, a trapezoidal wave, a triangular wave, or a sine wave.

14. The image forming apparatus of claim 1 or 2, wherein a quotient obtained by dividing a circumferential speed v of said developer carrier by a frequency f of said AC-superimposed bias voltage is not less than 0.09 mm.

15. The image forming apparatus of claim 14, wherein an average pitch of crests on a surface of said developer carrier is not greater than v/f.

16. The image forming apparatus of claim 1 or 2, wherein a surface of said developer carrier has been aluminum- or hard-plated, said surface being a roughened surface with spherical dimples.

17. The image forming apparatus of claim 1, wherein a development gap between said latent image carrier and said developer carrier is not more than 0.5 mm.

18. The image forming apparatus of claim 1, wherein a reciprocative nip width between said latent image carrier and said developer carrier is not less than 1 mm.

19. The image forming apparatus of claim 1, wherein a difference between an effective nip width and a reciprocative nip width between said latent image carrier and said developer carrier is not more than 1 mm.

20. In an image forming apparatus of the type comprising developing means, a latent image carrier, and latent image forming means, wherein a latent image formed on said latent image carrier by said latent image forming means is developed by said developing means to form an image, the improvement wherein said developing means applies an AC-superimposed bias voltage to a developer carrier to form a thin developer layer with a line-shaped uneven conveying surface on said developer carrier with a regulating member, and said latent image forming means forms a latent image on said latent image carrier by performing image processing using a vertical parallel-line screen.

21. In an image forming apparatus of the type comprising developing means, a latent image carrier, and latent image forming means, wherein a latent image formed on said latent image carrier by said latent image forming means is developed by said developing means to form an image, the improvement wherein said developing means applies an AC-superimposed bias voltage to a developer carrier to form a thin developer layer with a line-shaped uneven conveying surface on said developer carrier with a regulating member, and said latent image forming means forms a latent image on said latent image carrier by performing image processing using a screen structure for reproducing a halftone image, and wherein a pitch of said line-shaped uneven conveying surface is set so as not to be an integral multiple of a dot pitch in a feed direction of said screen nor an integral quotient of said dot pitch.

22. The image forming apparatus of claim 21, wherein said screen structure is a 45-degree tilted halftone dot screen, a horizontal parallel-line screen, or a hybrid parallel-line screen.

23. In an image forming apparatus of the type comprising developing means, a latent image carrier, and latent image forming means, wherein a latent image formed on said latent image carrier by said latent image forming means is developed by said developing means to form an image, the improvement wherein said developing means applies an AC-superimposed bias voltage to a developer carrier to form a thin developer layer with a line-shaped uneven conveying surface on said developer carrier with a regulating member, and wherein a frequency of said AC-superimposed bias voltage is set so as not to be an integral multiple of a frequency of lateral unevenness occurring in a feed direction of the developer carrier nor an integral quotient of the frequency of said lateral unevenness.

24. The image forming apparatus of claim 23, wherein the frequency of said lateral unevenness is a frequency of vibrations or feed irregularities inherent in said apparatus that contribute to occurrence of unevenness in the feed direction.

25. The image forming apparatus of claim 23, wherein the frequency of said lateral unevenness is a frequency of vibrations or feed irregularities due to a driving gear of said developing means that contribute to occurrence of unevenness in the feed direction.

26. The image forming apparatus of claim 23, wherein the frequency of said lateral unevenness is a frequency of vibrations or feed irregularities due to a driving gear of said latent image carrier that contribute to occurrence of unevenness in the feed direction.

27. In an image forming apparatus of the type comprising developing means, a latent image carrier, and latent image forming means, wherein a latent image formed on said latent image carrier by said latent image forming means is developed by said developing means to form an image, the improvement wherein said developing means applies an AC-superimposed bias voltage to a developer carrier to form a thin developer layer with a line-shaped uneven conveying surface on said developer carrier with a regulating member, and wherein a pitch of said line-shaped uneven conveying surface is set so as not to be an integral multiple of a pitch of stripes on the developer carrier occurring in a feed direction of the developer carrier nor an integral quotient of the pitch of said stripes.

28. The image forming apparatus of claim 20, 21, 23 or 27, wherein said regulating member has a semiconductive member provided at a distal end thereof, said semiconductive member being brought into contact with said developer carrier to produce an electric potential difference between said semiconductive member and said developer carrier, to which said AC-superimposed bias voltage is applied.

29. The image forming apparatus of claim 28, wherein said regulating member has a semiconductive rubber tip provided at a distal end thereof, said semiconductive rubber tip being brought into contact with a seal portion of said developer carrier without a developer being interposed therebetween.

30. The image forming apparatus of claim 28, wherein said regulating member has a rubber tip attached to a distal end of a leaf spring as said semiconductive member.

31. The image forming apparatus of claim 28, wherein said regulating member has a rubber tip with a volume resistivity of not more than $10^9$ Ωcm as said semiconductive member.

32. The image forming apparatus of claim 28, wherein said regulating member has a rubber tip with a hardness of 55 to 80 degrees according to JIS A as said semiconductive member.

33. The image forming apparatus of claim 28, wherein said regulating member has a urethane rubber tip as said semiconductive member.

34. The image forming apparatus of claim 28, wherein said regulating member abuts against said developer carrier at an edge thereof.

35. The image forming apparatus of claim 28, wherein said regulating member is placed at a floating potential or a ground potential or a constant potential.

* * * * *